US007604571B2

(12) United States Patent
Wilkins et al.

(10) Patent No.: US 7,604,571 B2
(45) Date of Patent: Oct. 20, 2009

(54) EXERCISE DEVICE WITH A USER-DEFINED EXERCISE MODE

(75) Inventors: Larry C. Wilkins, Ft. Lauderdale, FL (US); Vaughan Scott, Floyds Knobs, IN (US)

(73) Assignee: Scott & Wilkins Enterprises, LLC, Sellersburg, IN (US)

( * ) Notice: Subject to any disclaimer, the term of this patent is extended or adjusted under 35 U.S.C. 154(b) by 0 days.

(21) Appl. No.: 11/542,070

(22) Filed: Oct. 3, 2006

(65) Prior Publication Data

US 2007/0032353 A1 Feb. 8, 2007

Related U.S. Application Data

(63) Continuation-in-part of application No. 10/464,373, filed on Jun. 18, 2003, now Pat. No. 7,572,206.

(60) Provisional application No. 60/723,103, filed on Oct. 3, 2005.

(51) Int. Cl.
*A63B 71/00* (2006.01)

(52) U.S. Cl. ..... 482/8; 482/1; 482/9; 434/247

(58) Field of Classification Search ..... 482/1–9, 482/51, 54, 900–902; 434/247
See application file for complete search history.

(56) References Cited

U.S. PATENT DOCUMENTS 4,082,266 A 4/1978 Elkins
4,099,713 A 7/1978 Spector
4,544,154 A * 10/1985 Ariel ..... 482/5
4,702,475 A 10/1987 Elstein et al.
4,728,100 A 3/1988 Smith
4,813,665 A 3/1989 Carr
4,932,137 A * 6/1990 Haley et al. ..... 33/700
5,120,228 A 6/1992 Stahl et al.
5,186,695 A * 2/1993 Mangseth et al. ..... 482/6
5,294,912 A * 3/1994 Bednarz et al. ..... 340/323 R
5,584,779 A 12/1996 Knecht et al.
5,888,179 A 3/1999 Singhal
6,110,073 A 8/2000 Saur et al.
6,181,647 B1 * 1/2001 Tipton et al. ..... 368/10

* cited by examiner

*Primary Examiner*—Glenn Richman
(74) *Attorney, Agent, or Firm*—Finnegan, Henderson, Farabow, Garrett & Dunner, L.L.P.

(57) ABSTRACT

An exercise device including a support surface and at least two position sensors arranged along a sensing plane relative to the support surface, with the position sensors adapted to detect a presence of a user along the sensing plane. The exercise device further includes a controller in communication with the position sensors to determine a position of the user relative to the sensing plane. The controller has a closed loop feedback mode adapted to process at least one input parameter provided by the user, and to further measure a performance criteria of the user related to the input parameter and to provide feedback to the user indicative of a measurement of the performance criteria.

20 Claims, 12 Drawing Sheets

500a
504
20
404
30
402
500b
400
506
502
28
504
164
162a
318
506
316
336a
510
26
204a
160
214
302
508
202
304
24
144a
212
214
130a
334a
502
204b
330
334b
306
170
162b
130a
314
206
508
144b
144a
310
158a
165
120c
105
166b
300
200
336b
22
168a
130b
168b
100
L
T
102
P1
169
167

104
158b
120b
146
144b
146

EXERCISE DEVICE WITH A USER-DEFINED EXERCISE MODE

CROSS-REFERENCE TO RELATED APPLICATIONS

This application claims the benefit of U.S. Provisional Application No. 60/723,103 filed Oct. 3, 2005, and is a continuation-in-part of U.S. patent application Ser. No. 10/464,373 filed Jun. 18, 2003, each of which are incorporated by reference in their entirety.

FIELD OF THE INVENTION

The present invention relates generally to the field of exercise devices, and more particularly relates to an exercise device having position verification feedback.

BACKGROUND OF THE INVENTION

Various types and configurations of exercise devices have been developed to provide the user with an aerobic workout. Such devices include, for example, treadmills, stepping machines, cycling devices, rowing devices, etc. However, an exercise device has not been developed which provides a realistic simulation of the activity of jumping rope. Additionally, exercise devices for use in association with activities involving walking, running or jumping do not include features that provide for real-time feedback to verify the user's performance of selected parameters, such as, for example, features that provide accurate vertical position verification feedback. Moreover, exercise devices have not been developed which accurately measure and evaluate parameters associated with the vertical jumping ability of the user.

Thus, there is a general need in the industry to provide an improved exercise device. The present invention meets this need and provides other benefits and advantages in a novel and unobvious manner.

SUMMARY OF THE INVENTION

The present invention relates generally to an improved exercise device. While the actual nature of the invention covered herein can only be determined with reference to the claims appended hereto, certain forms of the invention that are characteristic of the preferred embodiments disclosed herein are described briefly as follows.

In one form of the present invention, an exercise device is provided having position verification feedback capabilities.

In another form of the present invention, an exercise device is provided that simulates that activity of jumping rope.

In a further form of the present invention, an exercise device is provided that is capable of measuring one or more parameters associated with a user's vertical jumping ability.

It is one object of the present invention to provide an improved exercise device. Further objects, features, advantages, benefits, and further aspects of the present invention will become apparent from the drawings and description set forth herein.

DESCRIPTION OF THE ILLUSTRATED EMBODIMENTS

Figure 1:
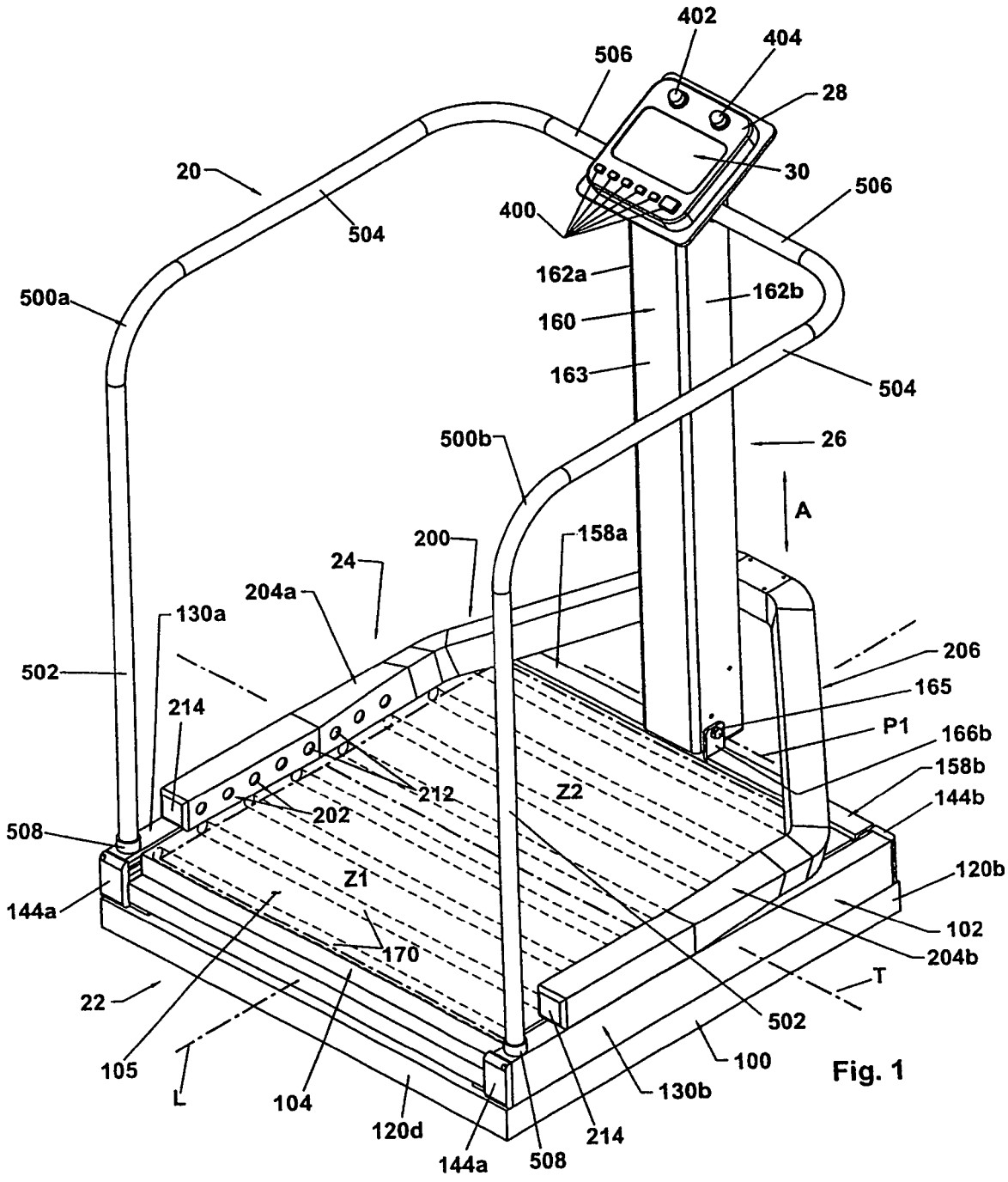
FIG. 1 is a front elevational perspective view of an exercise device according to one form of the present invention.

For the purposes of promoting an understanding of the principles of the invention, reference will now be made to the embodiments illustrated in the drawings and specific language will be used to describe the same. It will nevertheless be understood that no limitation of the scope of the invention is hereby intended, such alterations and further modifications in the illustrated devices, and such further applications of the principles of the invention as illustrated herein being contemplated as would normally occur to one skilled in the art to which the invention relates.

Referring to FIG. 1, shown therein is an exercise device 20 according to one form of the present invention. As will be discussed in greater detail below, the exercise device 20 may be used in association with multiple activities, and is particularly used in association with activities involving jumping, walking or running. For example, in one embodiment of the invention, the exercise device 20 is used to simulate the activity of jumping rope. In another embodiment of the invention, the exercise device 20 is used in association with walking or running in place. In a further embodiment of the invention, the exercise device 20 is used to measure vertical jumping ability and various parameters associated therewith. Each of these embodiments will be discussed in greater detail below. However, it should be understood that other embodiments of the invention are also contemplated, and that the exercise device 20 may be used in association with activities other than those specifically illustrated and described herein.

In the illustrated embodiment of the invention, the exercise device 20 is generally comprised of a base unit 22, an adjustable position sensor assembly 24, an adjustment mechanism 26, and a control panel 28 including a monitor or display 30. The function of each of these components of the exercise device 20 will now be summarized, followed by a more indepth discussion regarding the structural configuration and function of each of the components.

The base unit 22 includes a number of light sources or indicators that serve to provide a visual signal or cue to elicit a predetermined response from the user. In one embodiment, the elicited response is a jumping action. However, other elicited responses are also contemplated as falling within the scope of the invention, such as a walking action, a running action, a skipping action, or any other action associated with an exercise activity that would occur to one of skill in the art. The base unit 22 may also be equipped with a number of sensor elements that serve to determine the user's presence upon or absence from the base unit 22.

The adjustable position sensor assembly 24 includes a number of sensor elements that serve to determine whether or not the user's response satisfies a predetermined objective or goal, such as, for example, a predetermined elevation and/or an elapsed period of time. The adjustment mechanism 26 functions to vary the elevation or vertical position of the position sensor assembly 24 relative to the base unit 22 to correspondingly change the predetermined objective or goal of the user.

The control panel 28 controls and monitors operation of the various electrical components associated with the exercise device 20 and may be configured to provide visual and/or audible indications or cues to elicit a user response. The display 30 may also be configured to provide visual indications or cues to elicit a user response, and also serves to provide direct visualization of various parameters that are indicative of the user's performance of a predetermined activity as well as other types of information or data that may be useful to the user.

According to one embodiment of the invention, the base unit 22 is generally comprised of a support frame 100, a light source assembly 102, an upper mat or support pad 104, a support plate 106, and a pressure sensitive pad or strip 108. The components of the base unit 22 are preferably interconnected in such a manner as to form an integral base unit assembly. Additionally, the footprint of the base unit 22 is preferably sized as small as possible while still allowing for unrestrained/uninhibited movement of the user during performance of an exercise activity. Each of the components of the base unit 22 will now be discussed in greater detail.

In one embodiment of the invention, the support frame 100 is formed of a number of support members 120*a*-120*d* that are interconnected to form a substantially rigid framework for providing structural support and rigidity to the base unit 22. In the illustrated embodiment, the support frame 100 includes a pair of side support members 120*a*, 120*b* and front and rear support members 120*c*, 120*d* extending between the side support members 120*a*, 120*b*. The support frame 100 may also include a number of intermediate support members extending between the side support members 120*a*, 120*b* and/or the front and rear support members 120*c*, 120*d* to provide further structural support and rigidity to the base unit 22. In one embodiment of the invention, the support members 120*a*-120*d* are comprised of structural tubing formed of a lightweight material, such as, for example, a metallic material including aluminum or steel, a plastic or polymeric material, a composite material, or any other material that would occur to one of skill in the art. However, it should be understood that other types and configurations of support members and support structures are also contemplated as falling within the scope of the present invention. In a further embodiment of the invention, the base unit 22 may include a number of levelers (not shown) attached to the underside of the support frame 100 to provide a means for leveling the base unit 22, particularly when the base unit 22 is placed on an uneven surface.

In one embodiment of the invention, the light source assembly 102 is generally comprised of a pair mounting rails 130*a*, 130*b* and a plurality of light sources 132. The mounting rails 130*a*, 130*b* are positioned along the sides of the base unit 22, extending generally along the longitudinal axis L and secured to the side support frame members 120*a*, 120*b*, respectively. The light sources 132 are mounted to each of the mounting rails 130*a*, 130*b* and are disposed at intermittent locations along the longitudinal axis L. As will discussed in greater detail below, the light sources 132 are capable of illuminating discrete portions or bands of the base unit 22, and more particularly the upper support pad 104, to elicit a predetermined response from the user. It should be understood, however, that the light sources may be adapted to provide other types and configurations of illuminated areas or regions of the base unit 22.

Figure 6:
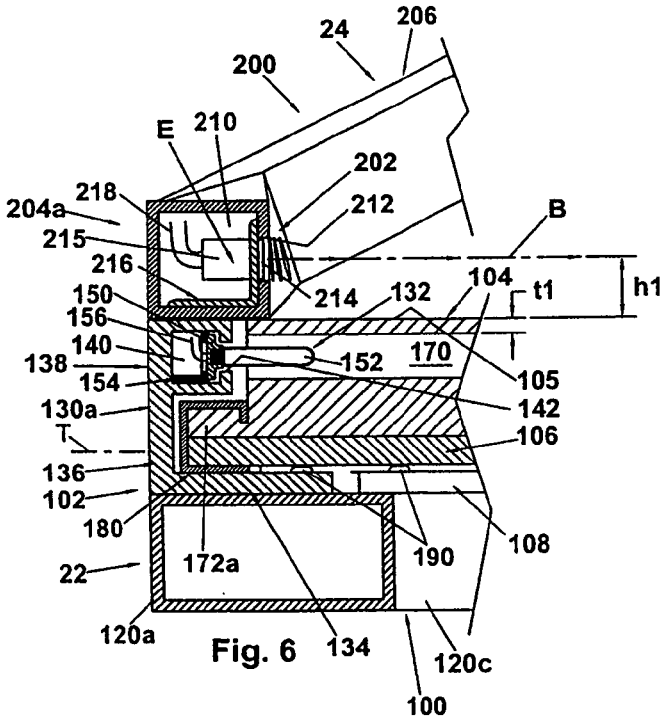
FIG. 6 is an enlarged cross sectional view of a portion of the base unit illustrated in FIG. 5.

Each of the mounting rails 130*a*, 130*b* is configured substantially identical to one another. Accordingly, only the mounting rail 130*a* will be described in detail, it being understood that the mounting rails 130*b* is configured substantially identical to mounting rail 130*a*. Referring specifically to FIG. 6, according to one embodiment of the invention, the mounting rail 130*a* includes a base portion 134 secured to the upper surface of the support frame member 120*a*, a leg portion 136 extending upwardly from the base portion 134, and a housing portion 138 positioned adjacent the end of the leg portion 136. The housing portion 138 defines a hollow interior region 140. A number of light source openings or apertures 142 are formed through a side wall of the housing portion 138 facing the inner area of the base unit 22. A pair of removable end caps or covers 144*a*, 144*b* (FIGS. 1 and 2) are preferably secured to opposite ends of each support rail 130*a*, 130*b* by a number of fasteners 146 (FIG. 2) to close off the ends of the support rails 130*a*, 130*b*, and more particularly the interior regions 140 of the housing portions 138.

In one embodiment of the invention, the light sources 132 are comprised of candescent or incandescent lights, with each light having a base portion 150 and an illumination or bulb portion 152. However, it should be understood that other types and configurations of light sources 132 are also contemplated as falling within the scope of the present invention, such as, for example, a fiber-optic light source, a fluorescent light source, a laser light source, an LED light source, an infrared light source, or any other type of light source that would occur to one of skill in the art. It should be appreciated that any light source that is capable of generating a visual indication, signal or cue to elicit a response from the user is contemplated for use in association with the present invention. It should further be appreciated that the light source may additionally be configured to provide non-visual indications, signals or cues to elicit a response from the user. It should also be understood that although the light sources 132 are illustrated and described as having a bulbous configuration, other configurations are also contemplated, such as, for example, a tubular configuration or filament configuration extending laterally across the base unit 22.

As most clearly shown in FIG. 6, the base portions 150 of the light sources 132 are positioned within the interior region 140 of the housing 138, with the bulb portions 152 extending through respective ones of the light source apertures 142. In one embodiment of the invention, the lights 132 associated with the mounting rails 130*a*, 130*b* are arranged in opposing pairs that are generally aligned across from one another. The base portions 150 of the lights 132 are secured to a mounting bracket 154 which is in turn engaged within the interior region 140 of the housing 138 to securely mount the lights 132 to the support rail 130*a*. Electrical leads 156 extend from each of the lights 132 and run through the interior region 140 of the housing 138 toward the front of the base unit 22. The leads 156 may be routed through laterally-extending tubular members 158*a*, 158*b* arranged at the front ends of the support rails 130*a*, 130*b* and up through the interior region of a vertical support column 160 to the control panel 28 (see FIG. 2). The control panel 28 functions to turn the lights 132 on and off at select time intervals, the details of which will be discussed below.

Figure 10:
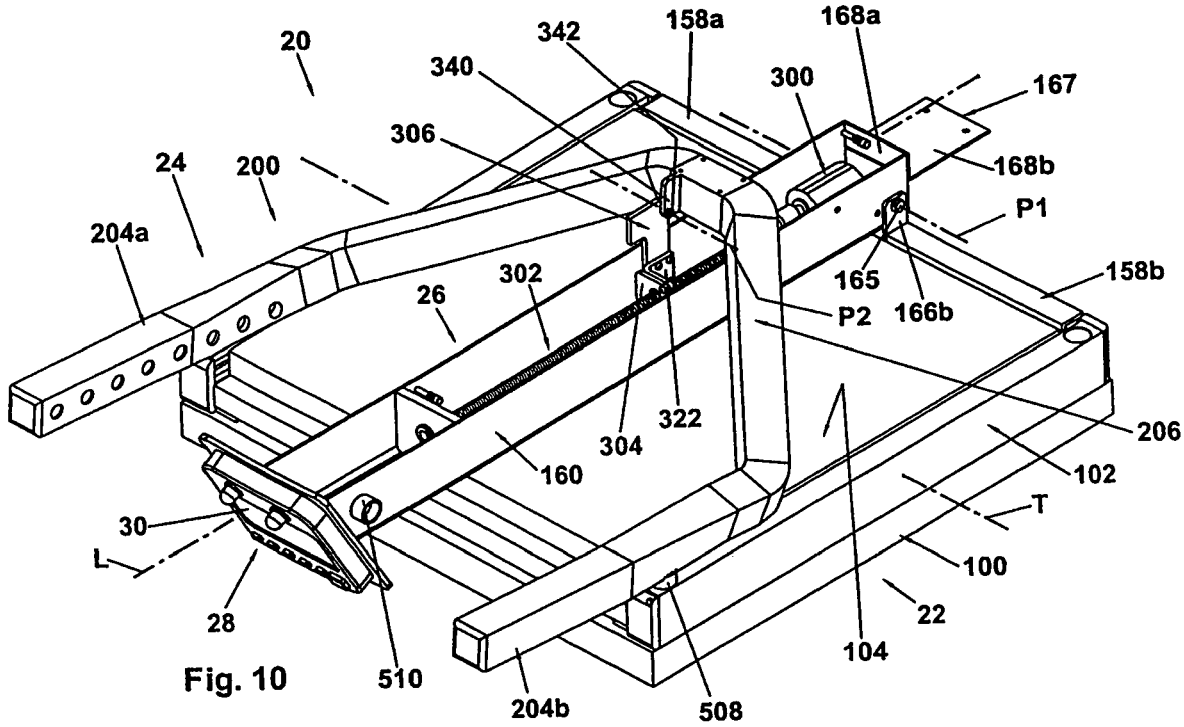
FIG. 10 is a front elevational perspective view of the exercise device illustrated in FIG. 1, as shown in a folded configuration adapted for transport or storage.

In one embodiment of the invention, the vertical support column 160 is generally comprised of a pair of side walls 162*a*, 162*b* and a front wall 163 defining a hollow interior region 164. A removable rear cover (not shown) may also be provided to enclose the interior region 164 and the working components of the adjustment mechanism 26. The vertical support column 160 is pivotally mounted to the base unit 22 via a pivot pin 165 passing between a pair of opposing yoke plates 166*a*, 166*b* (FIG. 5) extending upwardly from the laterally-extending tubular members 158*a*, 158*b*. In this manner, the vertical support column 160 is permitted to pivot about a pivot axis $P_1$ between a substantially vertical operational position (FIG. 1) and a substantially horizontal storage or transport position (FIG. 10).

Figure 2:
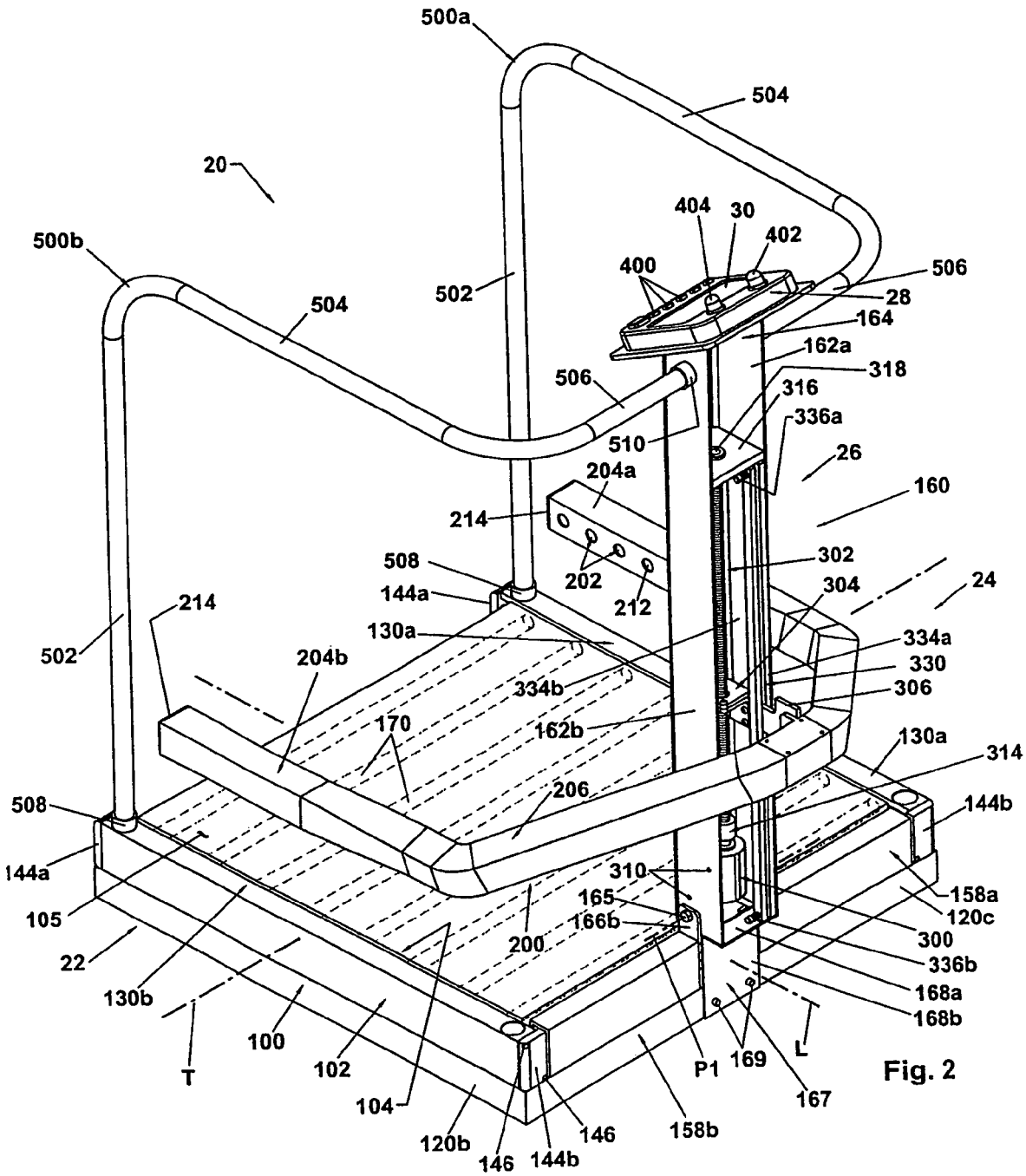
FIG. 2 is a rear elevational perspective view of the exercise device illustrated in FIG. 1.

The vertical support column 160 is selectively maintained in the vertical operational position via a bracket 167 having a flange plate portion 168*a* secured to the lower ends of the column side walls 162*a*, 162*b* and a base plate portion 168*b* that is selectively attached to the front frame support member 120*c* via a number of fasteners 169 (FIG. 2). However, other means for selectively maintaining the vertical column 160 in the vertical operational position are also contemplated as falling within the scope of the present invention. As should be appreciated, pivoting the support column 160 to the collapsed configuration illustrated in FIG. 10 provides for a more compact, lower profile configuration to facilitate transport of the exercise device 20 and/or storage of the exercise device 20 in areas having limited space, such as, for example, under a bed or in a closet.

In one embodiment of the invention, the upper support pad 104 defines an upper support surface 105 and is preferably formed of a resilient, shock-absorbing material that is strong enough to support the dynamic weight of the user during an activity such as jumping, running, walking, etc., while still providing a certain degree of give or flexible resilience to reduce the likelihood of a stress-related injury. Although the support pad 104 and the upper support surface 105 have been illustrated and described as having a generally flat, planar configuration, it should be understood that other configurations are also contemplated, including curved or angled configurations. The support pad 104 may be formed of a non-slip material to reduce the likelihood of user injury. Alternatively, the upper support surface 105 of the support pad 104 may be treated to provide a non-slip surface, such as, for example, by roughening the upper support surface 105 and/or by applying a non-slip material or coating to the upper support surface 105. In a preferred embodiment of the invention, the support pad 104 is formed of a transparent, translucent, semi-translucent or semi-opaque material that is capable of allowing for the transmission of an amount of light therethrough, the purpose of which will become apparent below. In a specific embodiment of the invention, the upper pad 104 is formed of a urethane material. However, other materials are also contemplated for use in association with the present invention, including various types of plastic materials, polymeric materials, or rubber materials.

Figure 5:
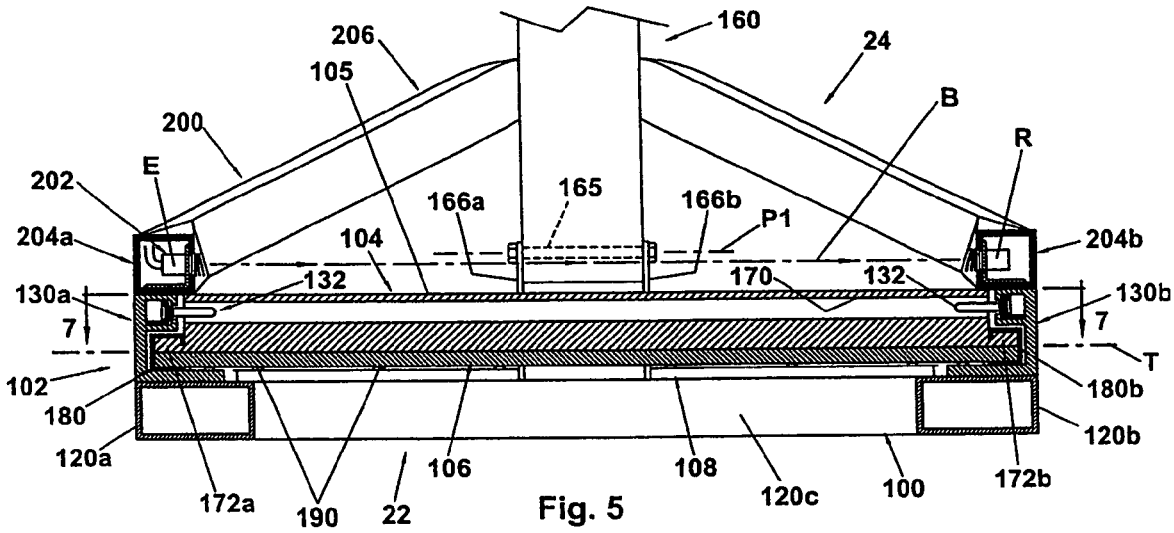
FIG. 5 is a cross sectional view of the base unit and sensor assembly of the exercise device illustrated in FIG. 4, as taken along line 5-5 of FIG. 4.
Figure 7:
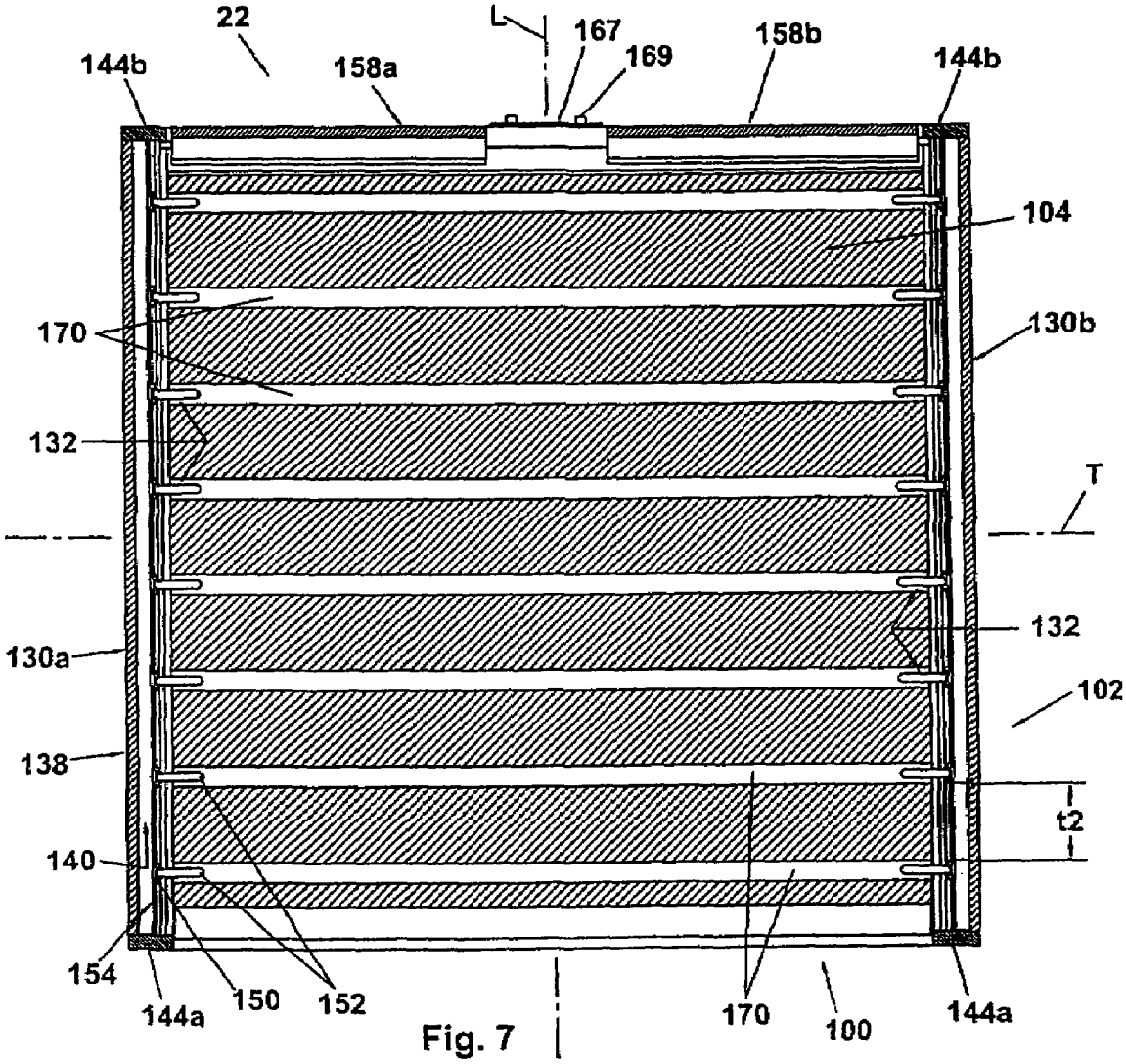
FIG. 7 is a cross sectional view of the base unit illustrated in FIG. 5, as taken along line 7-7 of FIG. 5.

As illustrated in FIGS. 5-7, a number of channels or openings 170 are formed through the support pad 104, extending laterally across the base unit 22. The support pad 104 also includes a pair of mounting flange portions 172*a*, 172*b* extending laterally from opposite sides of the support pad 104 and running substantially the entire length thereof, the purpose of which will be discussed below. In one embodiment of the invention, the channels 170 have a substantially circular cross section and are generally aligned with opposing pairs of the lights 132 such that activation of an opposing pair of the lights 132 will illuminate the region of the support pad 104 adjacent the corresponding light channel 170. The light channels 170 are preferably sized and positioned such that the thickness of material $t_1$ (FIG. 6) directly above the light channels 170 is significantly less than the thickness of material $t_2$ (FIG. 7) between adjacent ones of the light channels 170. In this manner, a majority of the light emitted by the lights 132 will be transmitted in an upward direction to illuminate the region of the support pad 104 above the corresponding light channel 170. Although a specific size, shape and configuration of the light channels 170 has been illustrated and described herein, it should be understood that other sizes, shapes and configurations of the light channels 170 are also contemplated as falling within the scope of the present invention.

Figure 8:
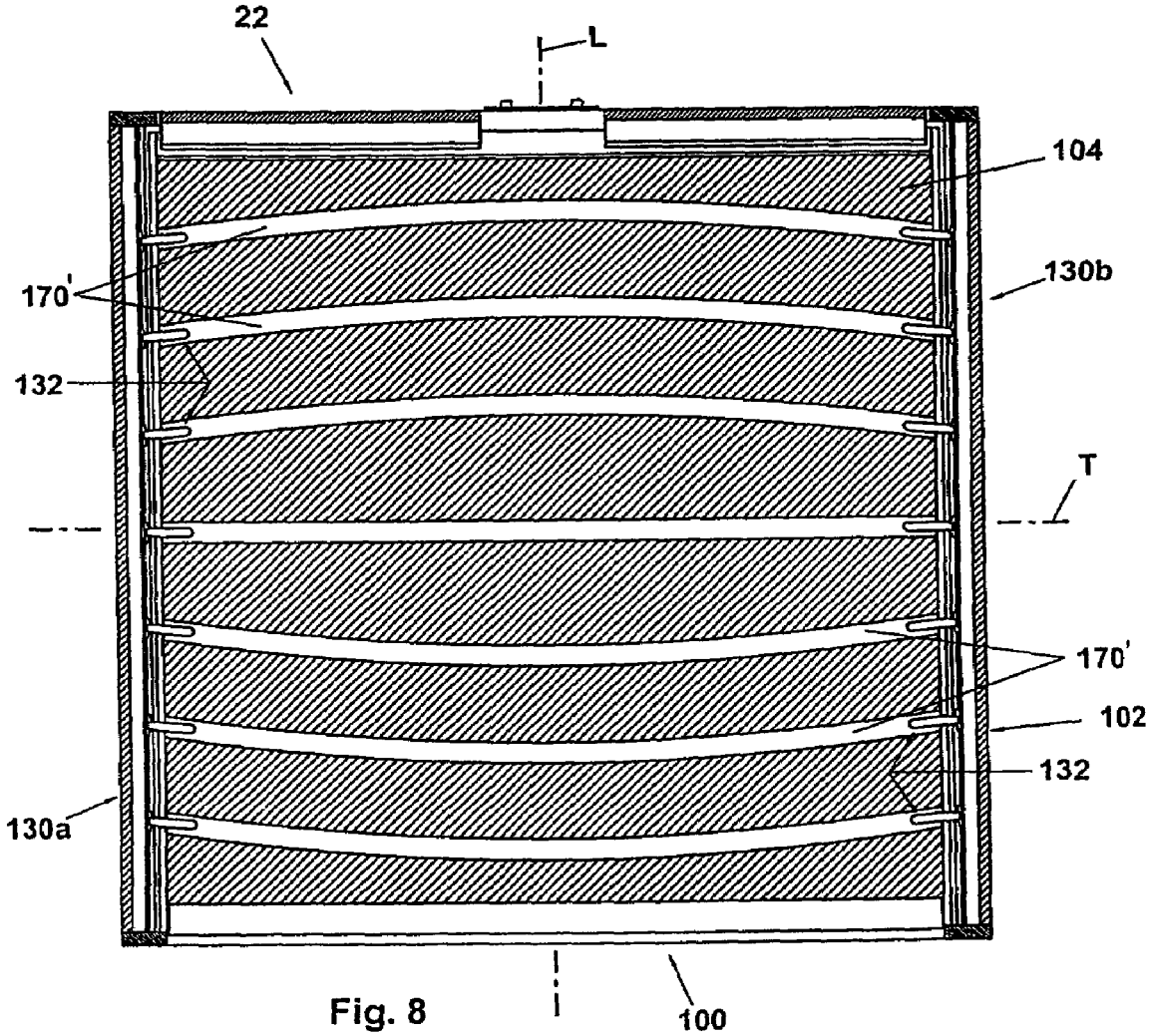
FIG. 8 is a cross sectional view of an alternative embodiment of the base unit illustrated in FIGS. 5 and 7.

In the illustrated embodiment of the invention, the light channels or lights bands 170 extend laterally across the base unit 22 and are generally aligned with the transverse axis T. However, it should be understood that in other embodiments of the invention, the light channels 170 may alternatively extend along the longitudinal axis L or in directions oblique to the transverse axis T. Furthermore, although the light channels 170 are illustrated as having a substantially linear configuration, it should be understood that in other embodiments of the invention, some or all of the light channels 170 may take on a non-linear configuration, such as, for example, an arcuate or curved configuration or a polygonal configuration. One such embodiment is illustrated in FIG. 8 wherein the light channels 170' positioned toward the front and rear of the base unit 22 have varying degrees of lateral curvature, the purpose of which will be discussed below. Additionally, although the light channels 170 are illustrated as being offset from one another by a substantially uniform distance, it should be understood that in other embodiments of the invention, the distance between the light channels 170 may be varied. Moreover, although the base unit 22 is illustrated as having eight (8) light channels 170, it should be understood that any number of light channels 170 may be used, including a single light channel 170.

In one embodiment of the invention, the support plate 106 is formed of a relatively rigid material, such as, for example, an aluminum material or a composite material. However, it should be understood that the support plate 106 may be formed of other materials as would occur to one of skill in the art, such as, for example, a plastic material or a polymeric material. The support plate 106 is positioned beneath the support pad 104 and is coupled thereto by a number of clip members 180 that extend about the lateral end portions of the support plate 106 and engage the mounting flange portions 172*a*, 172*b* of the support pad 104. The clip members 180 are in turn secured to the base portions 134 of the mounting rails 130*a*, 130*b* to engage the support pad 104 and the support plate 106 to the support frame 100.

In one embodiment of the invention, the pressure sensitive pad or strip 108 is formed of a relatively rigid material, such as, for example, an aluminum material or a composite material. However, the pressure sensitive pad 108 (FIGS. 5 and 6)

may also be formed of other materials as would occur to one of skill in the art, such as, for example, a plastic material or a polymeric material.

Referring to FIGS. 5 and 6, the pressure sensitive pad or strip 108 is positioned beneath the support plate 106 and is engaged to the support frame 100. A plurality of pressure sensors 190 are positioned along the upper surface of the pressure sensitive pad or strip 108 proximately adjacent the lower surface of support plate 106. A number of pressure sensors 190 may also be positioned between the support plate 106 and the base portion 134 of the mounting rails 130*a*, 130*b* and/or at other locations along the support plate 106. The pressure sensors 190 are electrically connected to the control panel 28. As should be appreciated, when the user stands upon the support pad 104, the weight of the user will slightly displace the support plate 106, thereby actuating one or more of the pressure sensor 190. The pressure sensors 190 in turn provide a signal to the control panel 28 to indicate the presence or absence of the user upon the support pad 104. Although a specific type and configuration of the pressure sensor 190 has been illustrated and described herein, it should be understood that other types and configurations of pressure sensors are also contemplated for use in association with the present invention as would occur to one of skill in the art.

Figure 4:
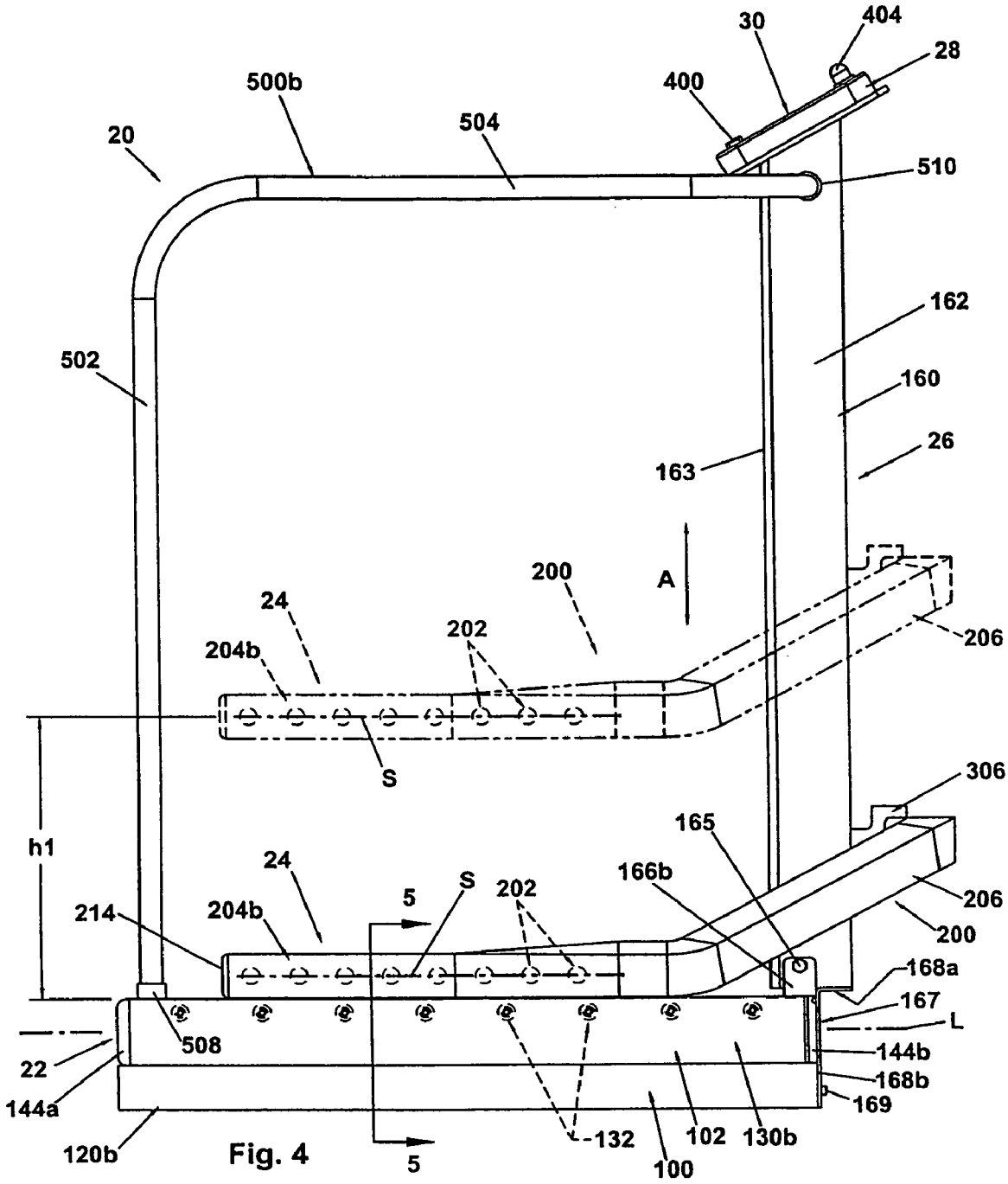
FIG. 4 is a side elevational view of the exercise device illustrated in FIG. 1.

According to one embodiment of the invention, the adjustable position sensor assembly 24 is generally comprised of a mounting structure 200 and a plurality of position sensors 202 mounted to the mounting structure 200. As illustrated in FIG. 4, the position sensors 202 are preferably arranged along a sensing plane S located above the upper surface 105 of the support pad 104 so as to detect the presence of the user along the sensing plane S. In a preferred embodiment of the invention, the sensing plane S is arranged substantially parallel with the upper surface 105 of the support pad 104. However, it should be understood that the sensing plane S may be arranged at an oblique angle relative to the support surface 105. Additionally, although the sensing plane S has been illustrated and described as having a generally flat or linear configuration, it should be understood that the sensing plane S may take on other configurations, such as, for example, a polygonal configuration or an arcuate or rounded configuration.

In the illustrated embodiment of the invention, the position sensor assembly 24 is comprised of a plurality of position sensors 202 positioned to define a single sensing plane S located above the upper surface 105 of the support pad 104 so as to detect the presence of the user along the sensing plane S. However, it should be understood that in other embodiments of the invention, the position sensor assembly 24 may include a plurality of position sensors 202 arranged so as to define multiple sensing planes S positioned at predetermined vertical intervals relative to one another. In this manner, the vertical adjustability feature of the position sensor assembly 24 may be eliminated if desired, relying instead upon the sensing of the presence and/or absence of the user along the multiple sensing planes S to correspondingly measure the vertical position of the user relative to the upper surface 105 of the support pad 104. In a further embodiment of the invention, the position sensor assembly 24 may include a plurality of position sensors 202 arranged so as to define one or more sensing planes S extending in a substantially vertical orientation to measure the position of the user relative to the upper surface 105 of the support pad 104.

In one embodiment of the invention, the mounting structure 200 includes a pair of mounting arms or bars 204*a*, 204*b* disposed along respective sides of the base unit 22. The mounting arms 204*a*, 204*b* preferably extend generally along the longitudinal axis L and are preferably positioned generally above the light source mounting rails 130*a*, 130*b*. However, other orientations and positions of the mounting arms 204*a*, 204*b* are also contemplated as falling within the scope of the present invention. The mounting arms 204*a*, 204*b* are interconnected to one another via a generally V-shaped or U-shaped base portion 206 which is in turn coupled to the vertical support column 160, the details of which will be discussed below. The position sensors 202 are mounted to and are disposed at intermittent axial locations along the mounting arms 204*a*, 204*b*.

The mounting arms 204*a*, 204*b* are configured substantially identical to one another. Referring to FIGS. 5 and 6, in one embodiment of the invention, the mounting arms 204*a*, 204*b* have a tubular configuration defining a hollow interior region 210. A number of sensor openings or apertures 212 (FIG. 6) are formed through a side wall of each of the mounting arms 204*a*, 204*b* facing the inner area of the base unit 22. A removable end cap or cover 214 (FIG. 1) is preferably positioned over the open end of each mounting arm 204*a*, 204*b* to close off the interior region 210 from the outer environment.

In one embodiment of the invention, the position sensors 202 are of the photoelectric type, with each position sensor 202 including an emitter unit E and a receiver unit R. As shown in FIGS. 5 and 6, the emitter and receiver units E, R are positioned within the interior regions 210 of the mounting arms 204*a*, 204*b*, with the emitting and receiving portions 214 of the units E, R generally aligned with respective ones of the sensor apertures 212. The base portions 215 of the units E, R are secured to a mounting bracket 216 which is in turn engaged within the interior region 210 of the mounting arms 204*a*, 204*b* to securely mount the sensors 202 to the mounting structure 200. Electrical leads 218 extend from each of the emitter and receiver units E, R and are run through the interior regions 210 of the mounting arms 204*a*, 204*b*, through the interior region of the base portion 206, and up along the vertical support column 160 to the control panel 28.

As should be appreciated, the emitter units E each emit a light beam B that is received or sensed by a corresponding receiver unit R, with each of the light beams B extending generally along the sensing plane S. As should also be appreciated, the emitter and receiver units E, R are arranged in opposing pairs, with an emitter unit E mounted to one of the mounting arms (e.g., 204*a*) and positioned in generally alignment with a corresponding receiver unit R mounted to the opposite mounting arm (e.g., 204*b*). When there is no obstruction present between the emitter unit E and the receiver unit R, the light beam B will remain unbroken and the receiver unit R will communicate a signal to the control panel 28 indicating an uninterrupted condition. However, when the light beam B is broken by an obstruction (e.g., by the user's foot or leg) the receiver unit R will communicate a signal to the control panel 28 indicating an interrupted condition. Accordingly, the position sensors 202 are capable of detecting the presence or absence of the user along the sensing plane S, and hence the position of the user relative to the base unit 22.

As will be discussed below, the height $h_1$ or elevation of the sensor assembly 24 and the position sensors 202 may be varied relative to the support surface 105 of the support pad 104 (FIG. 4) via the adjusting mechanism 26 to correspondingly adjust the height of the sensing plane S relative to the upper support surface 105. The adjustment mechanism 26 is preferably configured to provide approximately thirty-six (36) inches of vertical adjustment to the sensor assembly 24. In one embodiment of the invention, the light beams B are visible to provide the user with a visual indication as to the selected height $h_1$ of the position sensors 202 and the sensing plane S. Laser-type emitters E that emit a relatively intense/bright beam of light B are particularly suitable for visualization by the user; however, other types of emitters E are also contemplated as would occur to one of skill in the art. In order to provide enhanced visualization of the light beams B, the ambient lighting may be turned down and/or fog, smoke or another type of air-borne substance or material may be provided. Additionally, although the light beams B are illustrated as being linear, it should be understood that in other embodiments of the invention, the sensors 202 may be configured and arranged such that the light beams B are non-linear (e.g., curvilinear or angled).

In one embodiment of the invention, the number of position sensors 202 associated with the sensor assembly 24 corresponds to the number of the light channels 170 in the base unit 22. In the illustrated embodiment, the sensor assembly 24 includes eight (8) position sensors 202 corresponding to the eight (8) light channels 170 in the base unit 22. However, it should be understood that any number of position sensors 202 may be used, including a single position sensor 202, a pair of position sensors 202, or any other number of position sensors 202. It should also be understood that the number of position sensors 202 need not necessarily correspond to the number of light channels 170. Additionally, the position sensors 202 need not necessarily be aligned directly above a corresponding light channel 170, and need not necessarily be offset from one another by a uniform distance.

Figure 3:
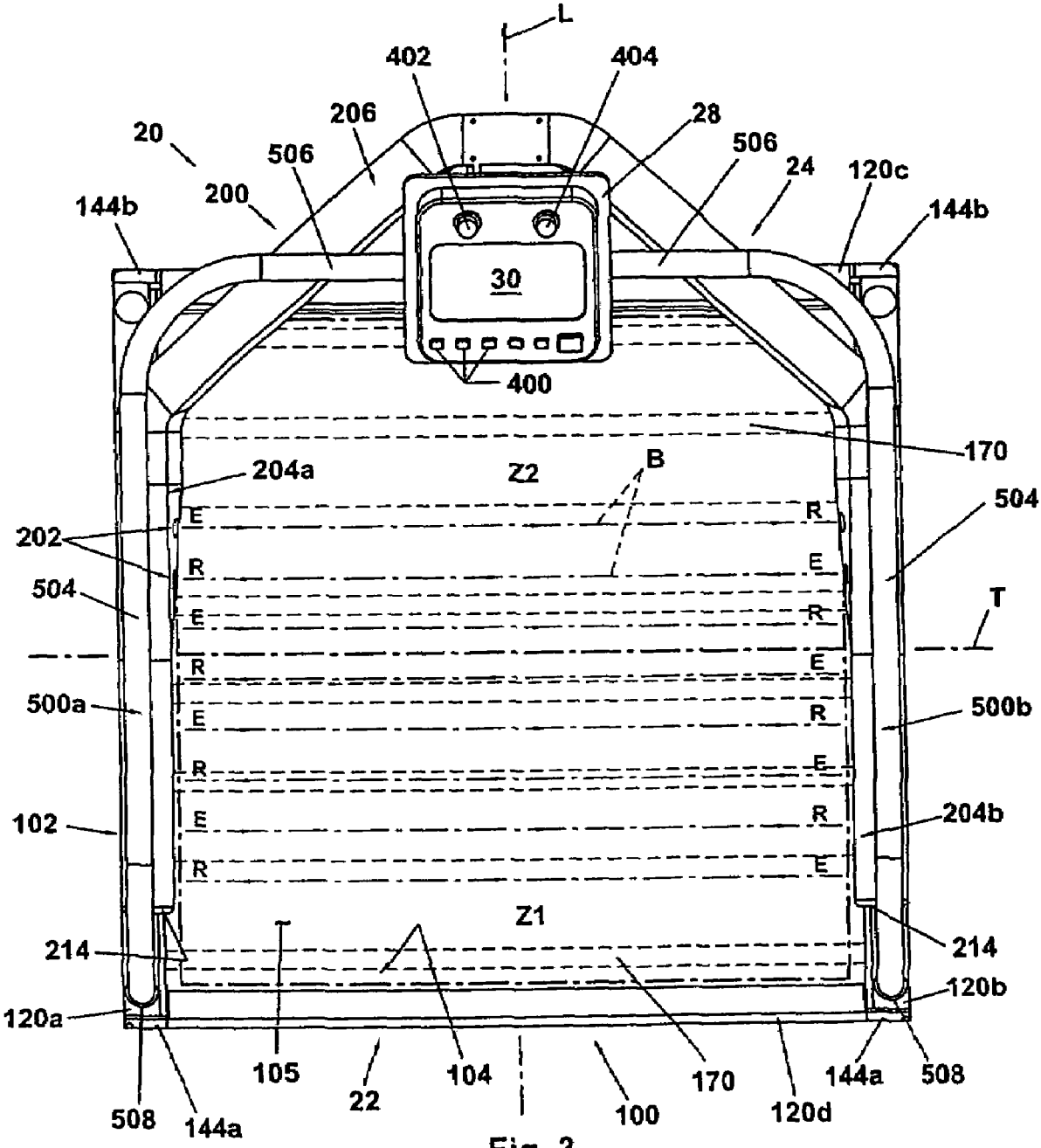
FIG. 3 is a top plan view of the exercise device illustrated in FIG. 1.

As illustrated in FIG. 3, the opposing pairs of the emitter and receiver units E, R are preferably arranged in a staggered or alternating configuration such that the receiver units R are separated from another by an intermediate emitter unit E. As a result, the likelihood that a receiver unit R will erroneously detect the light beam B emitted from the wrong emitter unit E is reduced. However, it should be understood that other configurations are also contemplated, including configurations where all of the emitter units E are mounted to one of the mounting arms (e.g., 204*a*) and all the receiver units R are mounted to the opposite mounting arm (e.g., 204*b*).

Although the position sensors 202 have been illustrated and described as photoelectric-type sensors, with each position sensor 202 including an emitter unit E and a receiver unit R, it should be understood that other types and configurations of position sensors are also contemplate as falling within the scope of the present invention. For example, instead of having separate emitter and receiver units E and R, in other embodiments of the invention, the emitter and receiver elements may be integrated into a single unit. In this alternative embodiment, the integrated emitter/receiver unit would be mounted to one of the mounting arms (e.g., 204*a*), with an optical reflector mounted to the other mounting arm (e.g., 204*b*) and positioned in generally alignment with the integrated emitter/receiver unit. As should be appreciated, the emitter portion of the integrated unit would emit a light beam that is reflected off of the optical reflector and back to the receiver portion of the integrated unit. Additionally, in lieu of photoelectric-type sensors, the sensor assembly 24 may include other types of position sensors, including various types and configurations of laser sensors, fiber optic sensors, optical sensors, motion sensors, infrared sensors, thermal sensors, ultrasonic sensors, capacitive sensors, proximity sensors, or any other type of position sensor that would occur to one of skill in the art.

Figure 9:
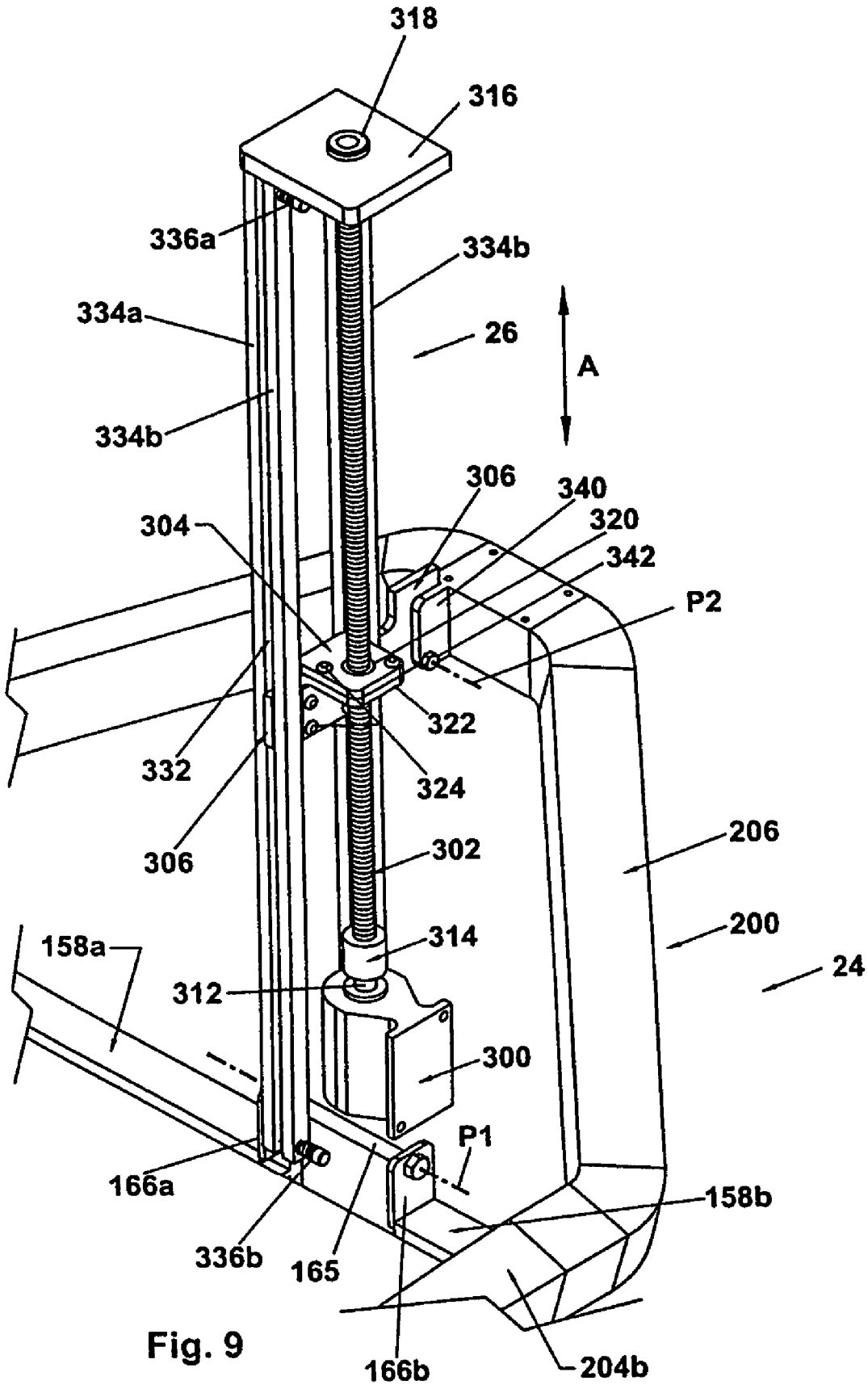
FIG. 9 is a front elevational perspective view of an adjustment mechanism for use in association with the exercise device illustrated in FIG. 1 to vary the elevation of the sensor assembly.

Referring to FIG. 9, according to one embodiment of the invention, the adjustment mechanism 26 is generally comprised of an actuator or electric drive motor 300, a threaded drive shaft or screw 302, and a threaded drive plate or nut 304 that is coupled to the sensor assembly 24 via a connector bracket 306. The drive motor 300 is electrically connected to the control panel 28. As should be appreciated, rotation of the drive motor 300 will correspondingly rotate the drive shaft 302, which in turn threadingly engages the drive plate 304 to vertically displace the sensor assembly 24 in the direction of arrows A. The speed of the drive motor 300 is preferably controllable so as to correspondingly adjust or regulate the rate of vertical displacement of the sensor assembly 24. As illustrated in FIG. 4, the adjustment mechanism 26 provides the capability to selectively adjust the height $h_1$ of the sensor assembly 24 relative to the base unit 22 within a range of operational positions. In a preferred embodiment of the invention, the adjustment mechanism 26 is configured to provide approximately thirty-six (36) inches of vertical adjustment. However, it should be understood that other ranges of vertical adjustment are also contemplated as falling within the scope of the present invention, including vertical adjustments and/or vertical heights of greater than thirty-six (36) inches.

As illustrated in FIG. 2, the adjustment mechanism 26 is housed within the interior region 164 of the vertical support column 160 (the support column 160 having been removed from FIG. 9 for purposes of clarity). The drive motor 300 is secured to the vertical support column 160, and more specifically to the side wall 162*b*, via a number of fasteners 310 or by any other means for attachment. The driven end of the drive shaft 302 is rotatably coupled to the output shaft 312 of the drive motor 300 via a coupling 314, with the free end of the drive shaft 302 rotatably mounted to an upper mounting plate 316 via a bushing or bearing 318. The drive plate 304 defines an internally threaded opening 320 that threadingly receives the drive shaft 302. The threaded opening 320 may be machined directly into the drive plate 304 or may be defined by an internally threaded bushing insert. The drive plate 304 is attached to the connector bracket 306 by an intermediate L-shaped bracket 322 which is secured to the drive plate 304 and the connector plate 306 via a number of fasteners 324 or by any other means for attachment. Alternatively, the drive plate 304 and the connector bracket 306 may be integrally formed as a single piece.

As most clearly shown in FIGS. 2 and 9, in the illustrated embodiment of the invention, the adjustment mechanism 26 includes a pair of guide tracks or channels 330 and 332 positioned at the front and rear of the support column 160. Front and rear portions of the connector bracket 306 are slidably displaced along the guide tracks 330, 332 to stabilize the connector bracket 306 and the sensor assembly mounting structure 200, particularly during adjustment of the height $h_1$ of the position sensors 202. In one embodiment, the guide tracks 330, 332 are defined by a pair of vertically-extending bars or rods 334*a*, 334*b* spaced apart a distance sufficient to slidably receive the connector bracket 306 therebetween. The guide bars 334*a*, 334*b* are interconnected via upper and lower studs or fasteners 336*a*, 336*b*. The studs 336*a*, 336*b* may define an externally threaded portion adapted for threading engagement within a threaded opening in one of the guide bars to provide a means for adjusting the width of the guide tracks 330, 332.

In one embodiment of the invention, the connector bracket 306 is pivotally attached to a mounting flange 340 extending from the base portion 206 of the sensor assembly mounting structure 200 via a pivot pin 342. In this manner, the sensor assembly 24 is allowed to pivot about a pivot axis $P_2$ between an operational position (FIG. 1), wherein the mounting arms 204*a*, 204*b* are arranged substantially perpendicular to the vertical support column 160, and a storage or transport position (FIG. 10) wherein the mounting arms 204*a*, 204*b* are arranged substantially parallel with the vertical support column 160. The sensor assembly 24 is selectively maintained in the operational position illustrated in FIG. 1 via abutment of an end surface of connector bracket 306 against the base portion 206 of the sensor assembly mounting structure 200. However, other means for selectively maintaining the sensor assembly 24 in the operational position are also contemplated as would occur to one of skill in the art. As should be appreciated, pivoting the sensor assembly 24 to the collapsed configuration illustrated in FIG. 10 provides for a more compact, lower profile configuration to facilitate transport of the exercise device 20 and/or storage of the exercise device 20 in areas having limited space, such as, for example, under a bed or in a closet.

Although a specific embodiment of an adjustment mechanism has been illustrated and described herein for adjusting the height $h_1$ of the position sensors 202, it should be understood that other means for adjustment are also contemplated as falling within the scope of the present invention. For example, a linear actuator could alternatively be used to adjust the height $h_1$, including various types and configurations of electric linear drives or pneumatic cylinder arrangements. A gear driven system is also contemplated, such as, for example, a rack and pinion type system. Additionally, a cabling system powered by a rotational or linear drive may also be used to adjust the height $h_1$. In another embodiment, a crank handle or a ratchet handle may be used to drive various types and configurations of adjustment mechanisms. In a further embodiment of the invention, the height $h_1$ may be manually adjusted by hand and locked into a selected position via a lock pin or clamp. Other means for adjusting the height $h_1$ are also contemplated as would occur to one of skill in the art. It should also be understood that in other embodiments of the invention, the sensor assembly 24 and the sensors 202 may be fixed at a predetermined non-adjustable height $h_1$.

According to one embodiment of the invention, as illustrated in FIG. 1, the control panel 28 is securely mounted to the upper end of the support column 160. The control panel 28 may be rotatably and/or pivotally mounted to the upper end of the support column 160 to accommodate for adjustment of the angular position and/or orientation of the control panel 28 relative to the user or a third party.

As discussed above, the control panel 28 controls and/or monitors the operation of the various electrical components associated with the exercise device 20. For example, the control panel 28 functions to activate/deactivate the light sources 132 in the base unit 22, power and receive feedback signals from the pressure sensors 190 in the base unit 22, power and receive feedback signals from the position sensors 202 of the position sensor assembly 24, and power and control operation of the electric drive motor 302 of the adjustment mechanism 26. As should be appreciated, the control panel 28 may also be used to control, monitor and/or power other electrical components associated with the exercise device 20 or other ancillary equipment. Power can be supplied to the control panel 28 and other electrical components via household current, one or more batteries, and/or by any other type of power supply known to those of skill in the art.

The control panel 28 is equipped with an electronic circuit board (not shown), a programmable controller (not shown) and/or any other type of electronic control system known to those of skill in the art. The control panel 28 preferably includes various buttons or keys 400 or other types of input devices (e.g., knobs, switches, a touch pad, etc.) to provide a user interface for inputting information and/or data to control operation of the various components and features associated with the exercise device 20. A heart monitor (not shown) may also be provided to monitor the user's heart rate, blood pressure, etc., the output of which may be communicated to the control panel 28 via a wireless or direct-wired connection.

The display 30 on the control panel 28 provides for direct visualization of various parameters that are indicative of the user's performance of an activity, such as, for example, information or data relating to the frequency and duration of the activity, the number of missteps or miscues, elapsed time, an estimate of the number of calories burned, measured heart rate or blood pressure, historical data relating to the activity, etc. The display 30 may also be used to convey other information or data to the user, such as, for example, component settings, a programming menu and/or operating instructions (e.g., a help screen), etc. In one embodiment of the invention, the display 30 is an LCD display. However, other types of displays are also contemplated, including plasma displays, CRT monitors, or any other type of display or monitor that would occur to one of skill in the art.

In addition to the display 30, the control panel 28 also includes a pair of indicator lights 402, 404 that provide visual indications or cues to the user to elicit a response, such as, for example, a jumping movement, and/or to provide visual confirmation or feedback signals to the user indicating that a predetermined parameter has been satisfied, such as, for example, jumping beyond a predetermined height (e.g., beyond the sensing plane S). In one embodiment, the indicator lights 402, 404 are of different colors (e.g., red and green) to allow the user to quickly and easily interpret the meaning behind the indication, cue, confirmation, and/or feedback signal corresponding to illumination of either of the lights 402, 404. The control panel 28 may also include a speaker or any other device that is capable of emitting a sound or tone to provide audible indications, cues, configurations and/or feedback signals to the user.

The exercise device 20 may also be equipped with a remote control device (not shown) configured to communicate with the control panel 28 to control operation of the various electrical components associated with the exercise device 20 from a remote location. The remote control device may include a display to provide remote visualization of various parameters associated with the user's performance of an activity, component settings, etc. The remote control device may be of the wireless type or may be hard wired into the control panel 28. The use of a remote control device may be particularly advantageous when a third party, such as, for example, a coach, trainer or instructor is present.

As illustrated in FIGS. 1 and 2, the exercise device 20 may be equipped with a pair of user supports or handrails 500*a*, 500*b* positioned on each side of the base unit 22. In one embodiment of the invention, the handrails 500*a*, 500*b* each include a rear portion 502 extending vertically from the base unit 22, a side portion 504 extending horizontally along the longitudinal axis L, and a front portion 506 extending horizontally along the transverse axis T and into engagement with the vertical support column 160. However, other configurations of handrails 500*a*, 500*b* are also contemplated as would occur to one of skill in the art. It should also be understood that the exercise device 20 need not necessarily be equipped with handrails.

Although the illustrated embodiment of the invention depicts the side portions 504 of the handrails 5002, 500*b* as having a generally linear configuration, it should be understood that the side portions 504 may be angled or curved. In a further embodiment of the invention, the side portions 504 have a generally circular cross section defining an outer diameter of between about one (1) inch and about three (3) inches to provide for secure and comfortable grasping by the user. Additionally, the side portions 504 may be treated to provide a non-slip surface to reduce the likelihood of user injury. Such a non-slip surface may be provided, for example, by roughening the outer surface of the side portions 504 via knurling or peening, by applying a non-slip material or coating to the outer surface of the side portions 504, and/or by providing hand grips that are formed of a non-slip material, such as, for example, plastic, rubber or foam.

In a further embodiment of the invention, the handrails 500*a*, 500*b* may be provided with a means for adjusting the height of the side portions 504 relative to the support pad 104 to accommodate users of different heights and/or different arm lengths. In one such embodiment, the vertically-extending rear portions 502 of the handrails 500*a*, 500*b* may include an inner tube portion that is telescopically received with an outer tube portion to provide for adjustment of the height of the side portions 504 relative to the support pad 104, and a clamp or fastener device, such as, for example, a pin or push button for locking the side portions 504 at a select height.

The handrails 500*a*, 500*b* are preferably selectively detachable from the base unit 22 and the support column 160 to accommodate transformation of the exercise device 20 into the collapsed configuration illustrated in FIG. 10 to facilitate transport and/or storage. In one embodiment of the invention, the ends of the vertical rear portions 502 of the handrails 500*a*, 500*b* are slidably received within mounting sleeves 508 extending upwardly from the mounting rails 130*a*, 130*b* of the base unit 22. Similarly, the ends of the horizontal front portions 506 of the handrails 500*a*, 500*b* are slidably received within mounting sleeves 510 extending laterally from the side walls 162*a*, 162*b* of the support column 160 (FIG. 2). The ends of the handrails 500*a*, 500*b* may be removably secured within the mounting sleeves 508, 510 via setscrews, pins, clamps, a friction fit, or by any other means of releasable engagement known to those of skill in the art. In an alternative embodiment of the invention, the handrails 500*a*, 500*b* may be pivotally attached to the base unit 22 in such a manner as to allow the handrails 500*a*, 500*b* to be folded to accommodate transformation of the exercise device 20 into the collapsed configuration illustrated in FIG. 10.

Figure 11:
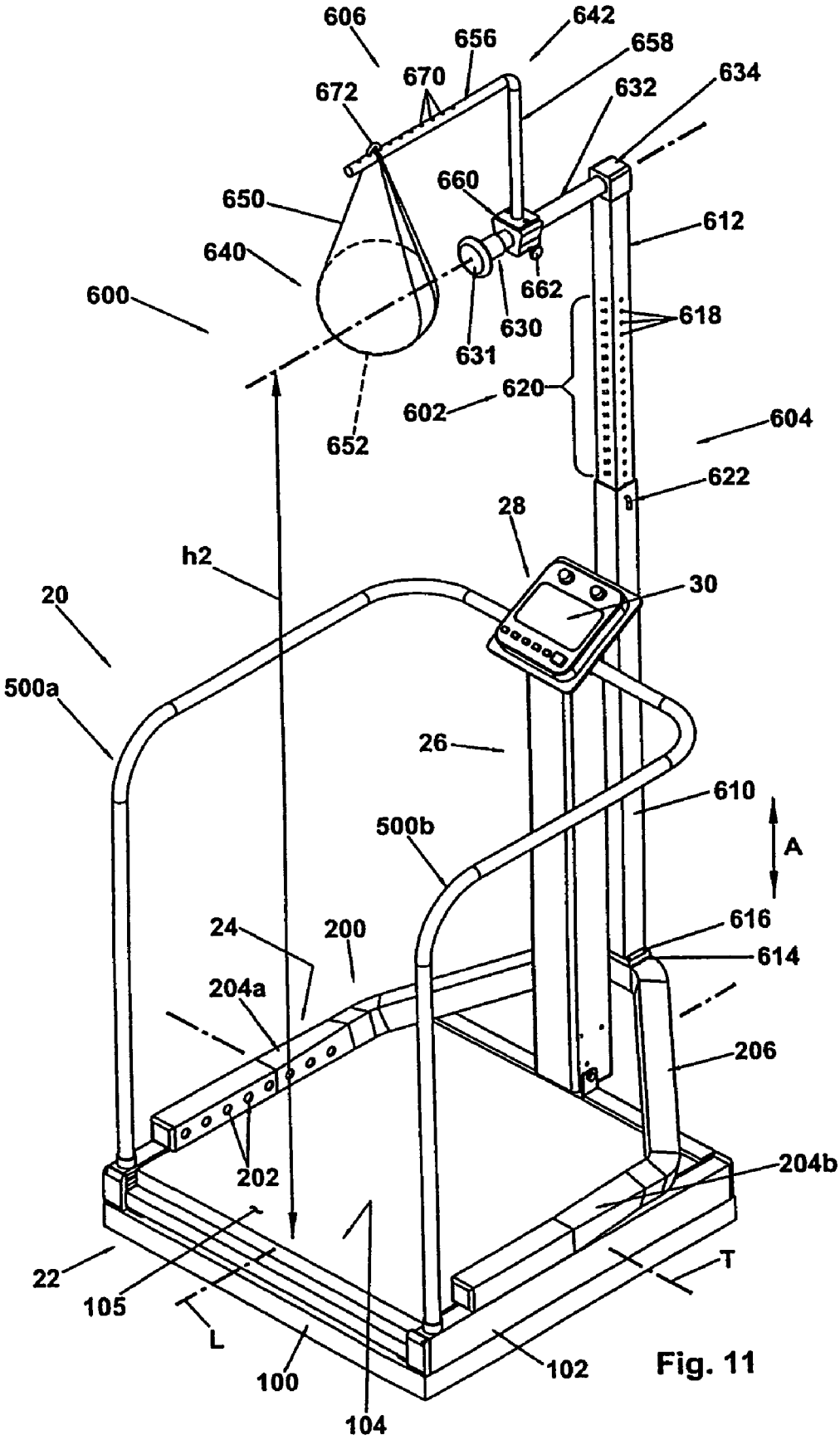
FIG. 11 is a front elevational perspective view of the exercise device illustrated in FIG. 1, as shown with one embodiment of a target attachment mounted thereto.
Figure 12:
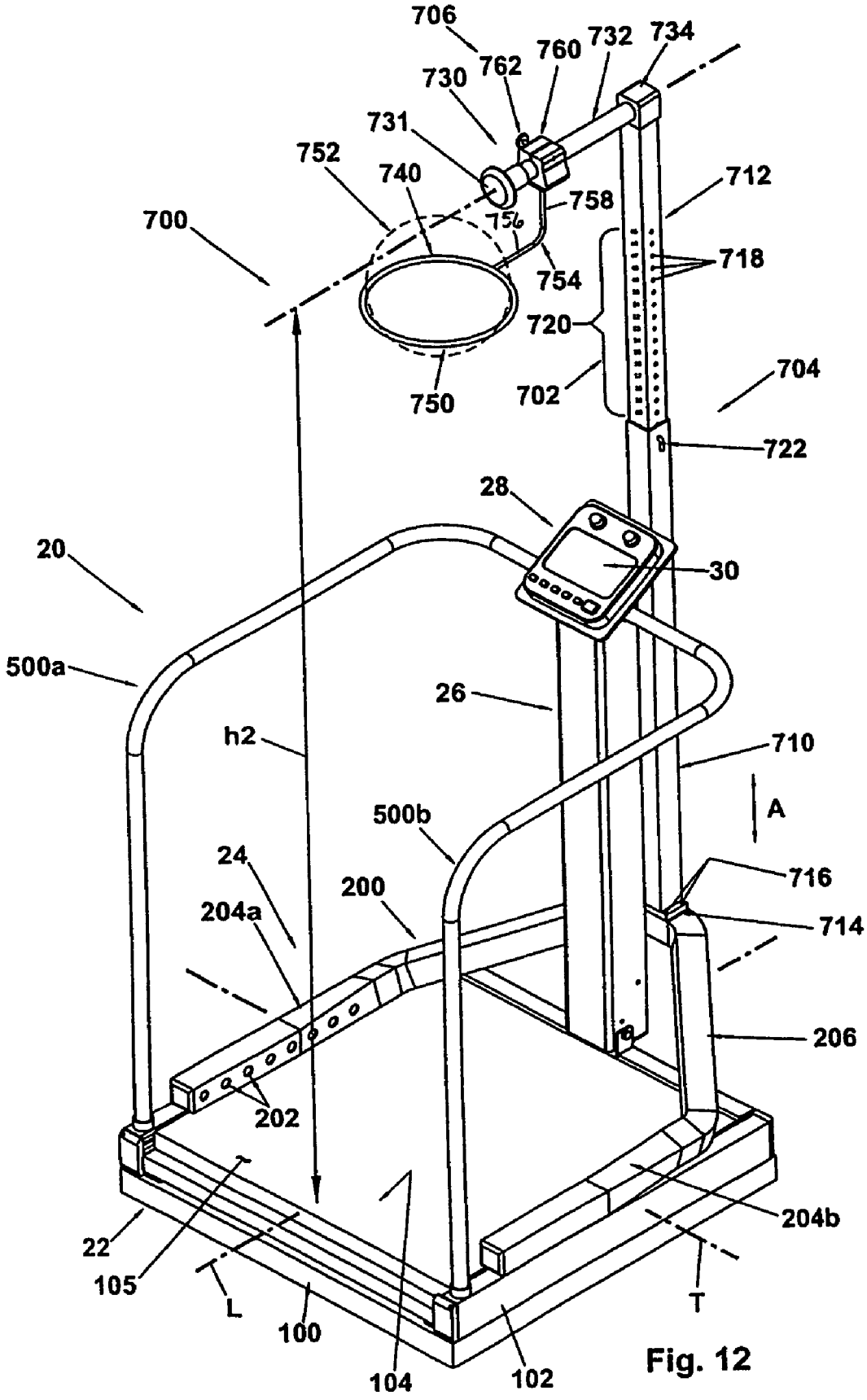
FIG. 12 is a front elevational perspective view of the exercise device illustrated in FIG. 1, as shown with another embodiment of a target attachment mounted thereto.

Referring to FIGS. 11 and 12, shown therein are exercise devices 600 and 700 according to further forms of the present invention. As will be discussed in greater detail below, the exercise devices 600 and 700 may be used in association with a variety of exercise activities. In a specific embodiment of the invention, the exercise devices 600 and 700 are used to measure and/or monitor various parameters associated with a user's vertical jumping ability, such as, for example, vertical jump height, timing, cadence, endurance, etc. However, it should be understood that the exercise devices 600 and 700 may be used in association with other activities and may be used to measure and/or monitor parameters other than those specifically illustrated and described herein.

The exercise device 600 is generally comprised of the exercise device 20 in combination with a target system 602. Similarly, the exercise device 700 is generally comprised of the exercise device 20 in combination with a target system 702. However, it should be understood that in other embodiments of the invention, either or both of the exercise devices 600, 700 may include modified versions of the exercise device 20. For example, in an alternative embodiment, the size of the footprint area of the base unit 22 may be enlarged to provide a greater area for performing various activities, such as, for example, jumping activities. The mounting structure 200 of the position sensor assembly 24 may likewise be enlarged to avoid interference with user activities. Other changes, additions, and/or modifications to the base unit 22, the position sensor assembly 24, the adjustment mechanism 26, the control panel 28 and the display 30 are also contemplated. For example, in an alternative embodiment of the invention, the base unit 22 need not necessarily include light sources 132 or light channels 170 formed in the support pad 104. Additionally, the exercise devices 600, 700 need not necessarily includes handrails 500*a*, 500*b*. Further, the exercise devices 600, 700 need not necessarily be configured to fold down into a collapsed configuration.

Referring specifically to FIG. 11, the target system 602 associated with the exercise device 600 is generally comprised of a vertical support rod or tube 604 and a target apparatus 606 attached to an upper portion of the support rod 604. Further details regarding the configuration and purpose of the support rod 604 and the target apparatus 606 will be discussed below.

According to one embodiment of the invention, the support rod 604 is generally comprised of a lower tube portion 610 and an upper tube portion 612 that is telescopically received with the lower tube portion 610. In this manner, the overall height $h_2$ or elevation of a target sensor 630 associated with the target apparatus 606 may be easily and conveniently adjusted relative to upper surface 105 of the support pad 104, the purpose of which will be discussed below. The lower tube portion 612 is preferably attached to the base portion 206 of the sensor assembly mounting structure 200 via a base plate 614. The base plate 614 is attached to the base portion 206 via a number of fasteners 616 such that adjustment of the sensor assembly height will correspondingly adjust the overall height $h_2$ of the target sensor 630, the purpose of which will be discussed below. However, it should be understood that the lower tube portion 612 may be attached to other portions of the mounting structure 200, other portions of the exercise device 20, or may be configured as a freestanding unit.

The upper tube portion 612 defines a number of openings 618 positioned incrementally along a length thereof, and a number of indicia markings 620 positioned adjacent respective ones of the openings 618. A pin 622 extends through an opening in the lower tube portion 610 and is inserted through a selected opening 618 in the upper tube portion 612 to selectively fix or lock the overall height $h_2$ of the target sensor 630 relative to the base unit 22. The indicia markings 620 are preferably numerals that correspond to the overall height $h_2$ of the target sensor 630 relative to the upper surface 105 of the support pad 104 when the sensor assembly 24 is positioned at its lowest operational position.

Although adjustment of the overall height $h_2$ of the target sensor 630 has been illustrated and described as a manual operation, it should be understood that in other embodiments of the invention, the overall height $h_2$ of the target sensor 630 may be adjusted automatically. In this manner, the overall height $h_2$ of the target sensor 630 may be adjusted relative to the upper surface 105 of the support pad 104 via direct input into the control panel 28 and/or via a remote control device (not shown). In embodiments of the invention including automatic adjustment of the overall height $h_2$ of the target sensor 630, it should be understood that such adjustment may occur independent of any vertical adjustment of the sensor assembly 24 (e.g., independent of adjustment of the sensor height $h_1$ of the position sensor 202).

In one embodiment of the invention, the overall height $h_2$ of the target sensor 630 may be programmed to automatically adjust to a predetermined target height prior to commencement of the user workout. However, in a further embodiment of the invention, the overall height $h_2$ of the target sensor 630 may be programmed to automatically adjust to predetermined varying target heights during the user's workout, or may be programmed to adjust to random target heights during the user's workout (i.e., programmed to adjust to moving target heights). It should be appreciated that various types of adjustment mechanisms may be used to vary the overall height $h_2$ of the target sensor 630, including, for example, a screw drive similar to that of the adjustment mechanism 26 illustrated and described above, a linear actuator including various types and configurations of electric linear drives or pneumatic cylinder arrangements, or a gear driven system such as a rack and pinion type system. Other means for adjusting the overall height $h_2$ of the target sensor 630 are also contemplated as would occur to one of skill in the art.

According to one embodiment of the invention, the target apparatus 606 is generally comprised of a target sensor 630 and a target attachment 640. However, it should be understood that in other embodiments of the invention, the target apparatus 606 need not necessarily include a target attachment 640. The target sensor 630 extends from a mounting bar 632 which is in turn attached to the upper portion of the support rod 604 via a mounting block 634. In the illustrated embodiment of the invention, the target sensor 630 has a push-button configuration including a sensor button 631. As should be appreciated, when the user engages the sensor button 631, such as, for example, by pressing or tapping upon the sensor button 631, the target sensor 630 sends a confirmation signal to the control panel 28, the purpose of which will be discussed below. Although a particular type and configuration of the target sensor 630 has been illustrated and described herein, it should be understood that other types and configurations of target sensors are also contemplated as falling within the scope of the present invention. For example, a wide variety of push-type or pull-type devices, such as, for example, rods or cords, may be used to send a confirmation signal to the control panel 28.

In one embodiment of the invention, the target attachment 640 is generally comprised of a holder 650 configured to retain a ball 652 in general alignment with the target sensor 630. In a specific embodiment, the ball holder 650 is configured as a mesh bag or net; however, other types and configurations of ball holders are also contemplated as falling within the scope of the present invention. The ball 652 may take on a number of sport-specific configurations, such as, for example, a volleyball, soccer ball, football, basketball, or any other type or configuration of ball that would occur to one of skill in the art. As will be discussed in greater detail below, the user may activate or trigger the target sensor 630 by engaging the ball 652 into contact with the sensor button 631. For example, if the ball 652 is a volleyball, the user may strike, hit or push the volleyball 652 into contact with the sensor button 631 to simulate spiking, volleying, tapping, etc. If the ball 652 is a soccer ball, the user may strike, hit or push the soccer ball 652 into contact with the sensor button 631 to simulate heading, kneeing, kicking, etc. If the ball 652 is a football, the user may strike, hit or push the football 652 into contact with the sensor button 631 to simulate batting, blocking, receiving, etc. If the ball 652 is a basketball, the user may strike, hit or push the basketball 652 into contact with the sensor button 631 to simulate rebounding, blocking, tipping, etc.

The target attachment 640 is attached to a connector rod 642 which is in turn coupled to the mounting bar 632, such as, for example, by a number of fasteners. In one embodiment of the invention, the connector rod 642 is L-shaped, including a horizontally-extending portion 656 and a vertically-extending portion 658. The vertically-extending portion 658 is coupled to the mounting bar 632 via a clamp block 660. The clamp block 660 is preferably configured for sliding displacement along the mounting bar 632 to correspondingly adjust the distance between the target attachment 640 and the target sensor 630. The clamp block 660 is securely clamped about the mounting bar 632 via the tightening of a thumbscrew 662 to lock the clamp block 660, and in turn the target attachment 640, in a select position relative to the target sensor 630. In the illustrated embodiment of the invention, the horizontally-extending portion 656 of the connector rod 642 includes a number of openings 670 along a length thereof. A hook 672 attached to the holder 650 is positioned within a select one of the openings 670 to provide additional means for adjusting the distance between the target attachment 640 and the target sensor 630.

Referring now to FIG. 12, the target system 702 associated with the exercise device 700 is generally comprised of a vertical support rod or tube 704 and a target apparatus 706 attached to an upper portion of the support rod 704. The support rod 704 is configured identical to the support rod 604 illustrated and described above with regard to the exercise device 600, including a lower tube portion 710 and an upper tube portion 712 that is telescopically received with the lower tube portion 710 such that the overall height $h_2$ of the target sensor 730 may be easily and conveniently adjusted relative to the upper surface 105 of the support pad 104.

The lower tube portion 712 is preferably attached to the base portion 206 of the sensor assembly mounting structure 200 via a base plate 714. The base plate 714 is attached to the base portion 206 via a number of fasteners 716 such that adjustment of the sensor assembly height will correspondingly adjust the overall height $h_2$ of the target sensor 730. The upper tube portion 712 defines a number of openings 718 positioned incrementally along a length thereof, and a number of indicia markings 720 positioned adjacent respective ones of the openings 718. A pin 722 extends through an opening in the lower tube portion 710 and is inserted through a select opening 718 in the upper tube portion 712 to selectively fix or lock the overall height $h_2$ of the target sensor 730. The indicia markings 720 are preferably numerals that correspond to the overall height $h_2$ of the target sensor 730 relative to the upper surface 105 of the support pad 104 when the sensor assembly 24 is positioned at its lowest operational position. As discussed above with regard to the exercise device 600, although adjustment of the overall height $h_2$ of the target sensor 730 has been illustrated and described as a manual operation, it should be understood that in other embodiments of the invention, the overall height $h_2$ of the target sensor 730 may be adjusted automatically. It should also be understood that such adjustment may occur independent of any vertical adjustment of the sensor height $h_1$ of the position sensor 202.

According to one embodiment of the invention, the target apparatus 706 is generally comprised of a target sensor 730 and a target attachment 740. However, it should be understood that in other embodiments of the invention, the target apparatus 706 need not necessarily include a target attachment 740. The target sensor 730 extends from a mounting bar 732 which is in turn attached to the upper portion of the support rod 704 via a mounting block 734. In the illustrated embodiment of the invention, the target sensor 730 has a push-button configuration including a sensor button 731. As should be appreciated, when the user presses or taps upon the sensor button 731, the target sensor 730 sends a confirmation signal to the control panel 28. Although a particular type and configuration of the target sensor 730 has been illustrated and described herein, it should be understood that other types and configurations of target sensors are also contemplated as falling within the scope of the present invention.

In one embodiment of the invention, the target attachment 740 is generally comprised of a holder 750 configured to retain a ball 752 in general alignment with the target sensor 730. In a specific embodiment, the ball holder 750 has a ring or hoop configuration sized and configured to support a round ball, such as, for example, a basketball. However, other types and configurations of ball holders are also contemplated as falling within the scope of the present invention. For example, an oblong hoop or a smaller diameter hoop may be used to retain a football in general alignment with the target sensor 730. The ball 752 may take on a number of sport-specific configurations, such as, for example, a basketball, football, or any other type or configuration of ball that would occur to one of skill in the art, such as, for example, a volleyball or soccer ball. As will be discussed in greater detail below, the user may activate or trigger the target sensor 730 by engaging the ball 752 into contact with the sensor button 731. For example, if the ball 752 is a basketball, the user may strike, hit or push the basketball 752 into contact with the sensor button 731 to simulate rebounding, blocking, tipping, etc. As should be appreciated, the ring or hoop configuration of the holder 750 does not positively retain the ball 752. As a result, the user may grasp the ball 752 during a jumping cycle, force the ball into contact with the sensor button 731, remove the ball 752 from the holder 750, and return the ball to the holder 750 during a subsequent jumping cycle.

In one embodiment of the invention, the target attachment holder 752 is coupled to the mounting bar 732 via an L-shaped connector rod 754, including a horizontally-extending portion 756 and a vertically-extending portion 758. The vertically-extending portion 758 is coupled to the mounting bar 732 via a clamp block 760. The clamp block 760 is preferably configured for sliding displacement along a length of the mounting bar 732 to adjust the distance between the target attachment 740 and the target sensor 730. The clamp block 760 is securely clamped about the mounting bar 732 via the tightening of a thumbscrew 762 to lock the clamp block 760, and in turn the target attachment 740, in a select position relative to the target sensor 730.

Having described the various components, functions and features associated with the exercise devices 20, 600 and 700, further details regarding the use and operation of the exercise devices will now be discussed below. According to one form of the invention, the exercise device 20 may be used to simulate the activity of jumping rope. In another embodiment of the invention, the exercise device 20 may be used in association with walking or running in place. In yet another embodiment of the invention, the exercise devices 600 and 700 may be used to measure parameters associated with a user's vertical jumping ability. It should be understood, however, that in other embodiments of the invention, the exercise devices 20, 600 and 700 may be used in association with other simulated or actual exercise activities.

With regard to the embodiment of the invention directed to the exercise activity involving a simulated jump rope, the control panel 28 is configured and/or programmed to activate (turn on) the light sources 132 in a sequential manner, preferably in a front to back direction (e.g., from the front of the base unit toward the rear of the base unit). However, it should be understood that the light sources 132 may alternatively be activated in a sequential manner in a back to front direction. As should be appreciated, activation of the light sources 132 associated with a corresponding light channel 170 will illuminate a discrete band or strip of the support pad 104 directly above that light channel 170. As should also be appreciated, upon the sequential activation of each light source 132, the adjacent light source 132 toward the front of the base unit 22 will be deactivated (turned off).

The sequential activation/deactivation of the light sources 132 has the effect of providing a virtual simulation of a jump rope passing beneath the user's feet. As illustrated in FIG. 8 and described above, the light channels 170' positioned toward the front and rear of the base unit 22 may be configured to have varying degrees of lateral curvature to provide an even more realistic simulation of a jump rope passing beneath the user's feet. The speed and frequency at which the light sources 132 are sequentially activated and deactivated can be varied via the control panel 28 to adjust the speed and frequency (e.g., cadence) at which the virtual jump rope passes beneath the user's feet, thereby enabling the user to control his or her aerobic workout level.

As the light sources 132 are sequentially activated and deactivated, the user is cued to react by "jumping over" the virtual jump rope (i.e., the illuminated light band extending across the support pad 104) as the virtual jump rope passes directly beneath the user's feet. Additionally, the user must jump high enough to clear the virtual jump rope. The position sensors 202 can function to verify or confirm that the user has in fact cleared the virtual jump rope as it passes beneath the user's feet. The pressure sensors 190 associated with the pressure sensitive pad or strip 108 may also be used to verify that the user actually jumped off of the support pad 104 and/or that the user jumped at the appropriate time to clear the virtual jump rope.

As should be appreciated, if the user jumps high enough to extend above the sensing plane S (i.e., above the light beams B), the position sensors 202 will send a confirmation signal to the control panel 28 that a successful jump has been executed. In turn, a visual and/or non-visual indication may be provided to confirm that the jump was successful. In one embodiment, one of the indicator lights 402, 404 (e.g., a green light) will illuminate to provide visual confirmation to the user that the jump was successful. However, other types of indications are also contemplated, such as, for example, other types of lights, graphical symbols, audible signals, and/or other types of visual and/or non-visual indications that would occur to one of skill in the art. If the user fails to extend above the sensing plane S, at least one of the light beams B will remain broken by the user's legs or feet. As a result, one or more of the position sensors 202 will send a signal to the control panel 28 indicating that the jump was unsuccessful (e.g., a miscue). In turn, a visual and/or non-visual indication may be provided to confirm that the jump was successful, such as, for example, illumination of one of the indicator lights 402, 404 (e.g., a red light) to provide visual confirmation to the user that the jump was unsuccessful. The light 402, 404 indicating a successful jump (e.g., the green light) will preferably remain illuminated until an unsuccessful jump has been detected. As discussed above, the height $h_1$ of the position sensors 202 may be adjusted to correspondingly adjust the height at which the user must jump to clear the virtual jump rope. As a result, the user is able to control his or her anaerobic workout level. It should be understood that the height $h_1$ of the position sensors 202 may be adjusted before or during the user's workout, and may be adjusted manually by the user or automatically by the control panel 28.

In one embodiment of the invention, the position sensors 202 may be sequentially activated/deactivated substantially synchronously with the sequential activation/deactivation of the light sources 132. In other words, the activation/deactivation of the position sensors 202 may be configured to substantially track the activation/deactivation of the light sources 132. As discussed above, the light beams B generated by the position sensors 202 may be configured to be visible by the user so as to provide a visual indication of the selected height $h_1$ of the position sensors 202 and the sensing plane S relative to the support pad 104. In this manner, the light beams B provide further simulation of the virtual jump rope passing beneath the user's feet while at the same time providing the user with an easily identifiable indication as to the height the user must jump to clear the virtual jump rope. In a further embodiment of the invention, additional light sources or cueing devices may be mounted to one or both of the mounting arms 204*a*, 204*b* of the sensor frame 200 which illuminate substantially synchronously with the respective light sources 132 to provide further indication as to when and how high the user must jump to clear the virtual jump rope. Non-visual signaling devices, such as, for example, audible signaling devices, may also be mounted to one or both of the mounting arms 204*a*, 204*b* of the sensor frame 200 to provide further indication as to when and how high the user must jump to clear the virtual jump rope.

The pressure sensors 190 associated with the pressure sensitive pad or strip 108 may be used in addition to or in lieu of the position sensors 202 to verify or confirm whether a jump was successful or unsuccessful. As should be appreciated, if the user jumps off of the support pad 104 at the appropriate time as the virtual jump rope passes beneath the user's feet, the pressure sensors 190 will send a confirmation signal to the control panel 28 that a successful jump has been executed and one of the indicator lights 402, 404 (e.g., a green light) will illuminate. However, if the user fails to jump off of the support pad 104 at the appropriate time, one or more of the pressure sensors 190 will send a signal to the control panel 28 indicating that the jump was unsuccessful and one of the indicator lights 402, 404 (e.g., a red light) will illuminate. The light 402, 404 indicating a successful jump (e.g., the green light) will preferably remain illuminated until an unsuccessful jump has been detected.

As discussed above, the control panel 28 may be configured to generate a visual signal on the display 30, an audible signal, and/or other types of signals to indicate that a particular jump was successful or unsuccessful. Additionally, it should be understood that the "signal" sent to the control panel 28 by the position sensors 202 and/or the pressure sensors 190 can take the form of an actual electronic signal or may take the form of the absence of an electronic signal. It should also be understood that the control panel 28 may be programmed with predetermined workout parameters or settings that will automatically vary the speed and frequency of the virtual jump rope passing beneath the user's feet and/or the height at which the user must jump to clear the virtual jump rope. In this manner, the user may work out without interruption or distraction and without having to manually change the parameters or settings of the exercise device 20.

The anaerobic benefits of the exercise device can be enhanced via the use of hand, waist or ankle weights in conjunction with the rope jumping activity. Notably, unlike the actual activity of jumping rope, the virtual jump rope generated by the exercise device 20 frees up the user's hands to allow the user to perform other functions (e.g., grasping hand weights, balancing via the handrails 500*a*, 500*b*, etc.). Additionally, the user does not have to concentrate on the proper handling of the rope and keeping their feet and legs clear of the rope, thereby enabling the user to concentrate solely on the jumping activity itself. As a result, user safety and comfort is significantly enhanced. Moreover, the user has a totally free range of motion with regard to both their hands and legs.

With regard to the embodiment of the invention directed to use of the exercise device 20 in association with the activity of walking or running in place, as illustrated in FIGS. 1 and 3, the base unit 22 and the sensor assembly 24 are configured to define a first zone $Z_1$ and a second zone $Z_2$, with each of the zones extending generally along the transverse axis T. However, it should be understood that the base unit 22 and the sensor assembly 24 may be divided into any number of zones, including three or more zones, and that the zones may extend in other directions, including a direction extending generally along the longitudinal axis L. Each of the first and second zones $Z_1$, $Z_2$ includes a number of the light sources 132 that selectively illuminate a corresponding number of the light channels 170, and a number of position sensors 202 that emit a corresponding number of the light beams B. Although the illustrated embodiment of the invention depicts each of the zones $Z_1$, $Z_2$ as having four (4) light channels 170 and four (4) light beams B, it should be understood that other configurations are also contemplated, including configurations wherein each of the zones $Z_1$, $Z_2$ include a single light channel 170 and a single light beam B.

In the illustrated embodiment of the invention, the user faces a transverse direction (i.e., toward either side of the base unit 22) and places one foot (e.g., the right foot) within the first zone $Z_1$ and the other foot (e.g., the left foot) within the second zone $Z_2$. The control panel 28 is configured and/or programmed to activate and deactivate the light sources 132 in the first and second zones $Z_1$, $Z_2$ in an alternating manner. Activation of the light sources 132 in the first zone $Z_1$ cues the user to react by raising his or her right foot off of the support pad 104. After a period of time, the light sources 132 in the first zone $Z_1$ will deactivate, thereby cueing the user to react by placing his or her right foot back onto the support pad 104. The light sources 132 in the second zone $Z_s$ will then activate, cueing the user to react by raising his or her left foot off of the support pad 104. In one embodiment, activation of light sources 132 in the second zone $Z_s$ occurs virtually simultaneously with deactivation of the light sources 132 in the first zone $Z_1$. However, a delay between activation and deactivation of the light sources 132 associated with the first and second zones $Z_1$, $Z_2$ is also contemplated. After a period of time, the light sources 132 in the second zone $Z_2$ will deactivate, thereby cueing the user to react by placing his or her left foot back onto the support pad 104. The light sources 132 in the first zone $Z_1$ will once again activate, and the activation/deactivation sequence of the first and second zones $Z_1$, $Z_2$ will be repeated indefinitely. It should be understood that in another embodiment of the invention, deactivation of the light sources 132 may be used to cue the user to raise his or her foot off of the support pad 104, while activation of the light sources cues the user to place his or her foot back onto the support pad 104.

As should now be appreciated, activation and deactivation of the first and second zones $Z_1$, $Z_2$ in an alternating manner provides the user with visual indications which, if followed, will cue the user to walk or run in place. As should also be appreciated, the speed at which the first and second zones $Z_1$, $Z_2$ are activated and deactivated can be varied via the control panel 28 to adjust the speed (i.e., cadence) at which the user must walk or run in place, thereby enabling the user to control his or her aerobic workout level. The user may set the speed before beginning the workout or may manually adjust the speed setting at any point during the workout. Additionally, the control panel 28 may be programmed with various speed settings that remain constant throughout the user's workout, or which are automatically adjust at various points during the user's workout. In this manner, the user may work out without interruption or distraction.

In another aspect of the invention, the position sensors 202 may be used to verify or confirm that the user raised his or her foot off of the corresponding zone $Z_1$, $Z_2$ at the appropriate time and at the appropriate elevation above the upper surface 105 of the support pad 104. In a further aspect of the invention, pressure sensors 190 located beneath respective ones of the first and second zones $Z_1$, $Z_2$ may also be used to verify that the user raised his or her foot off of the corresponding zone $Z_1$, $Z_2$ at the appropriate point in time.

As should be appreciated, if the user raises his or her foot high enough to extend above the sensing plane S (i.e., above the light beams B), the position sensors 202 will send a confirmation signal to the control panel 28 indicating that the user is successfully performing the walking/running activity. In turn, one of the indicator lights 402, 404 (e.g., a green light) will illuminate to provide visual confirmation to the user that he or she is performing successfully. However, if the user fails to extend above the sensing plane S, at least one of the light beams B will remain broken by the user's leg or foot. As a result, one or more of the position sensors 202 will send a signal to the control panel 28 indicating the user's unsuccessful performance of the activity (e.g., a misstep or miscue). In turn, one of the indicator lights 402, 404 (e.g., a red light) will illuminate to provide visual confirmation to the user regarding his or her unsuccessful performance of the activity. The light 402, 404 indicating successful performance (e.g., the green light) will preferably remain illuminated until a misstep or miscue has been detected. As discussed above, the height $h_1$ of the position sensors 202 may be adjusted relative to the upper surface 105 of the support pad 104, thereby resulting in an adjustment to the height at which the user must raise his or her feet to clear the light beams B. As a result, the user is able to control his or her anaerobic workout level. It should be understood that the height $h_1$ of the position sensors 202 may be adjusted before or during the user's workout, and may be adjusted manually by the user or automatically by the control panel 28.

In one embodiment of the invention, the position sensors 202 associated with each of the respective zone $Z_1$, $Z_2$ may be activated/deactivated in an alternating manner to correspond with the alternating activation/deactivation of the light sources 132. In other words, the activation/deactivation of the position sensors 202 within the respective zone $Z_1$, $Z_2$ may be configured to substantially track the activation/deactivation of the light sources 132 within the respective zone $Z_1$, $Z_2$. As discussed above, the light beams B generated by the position sensors 202 may be configured to be visible by the user so as to provide a visual indication of the selected height $h_1$ of the position sensors 202 and the sensing plane S relative to the support pad 104. In this manner, the light beams B provide the user with an easily identifiable indication as to the height at which the user's foot must be raised to clear the sensing plane S. In a further embodiment of the invention, additional light sources or cueing devices may be used to cue the user as to when his or her foot should be raised off of the support pad 104. In one embodiment, additional light sources or cueing devices may be mounted to one or both of the mounting arms 204*a*, 204*b*, or at other locations, which illuminate substantially synchronously with the light sources 132 within the respective zone $Z_1$, $Z_2$ to provide further indication as to when the user must raise his or her foot off of the support pad 104.

The pressure sensors 190 located beneath respective ones of the first and second zones $Z_1$, $Z_2$ may be used in addition to or in lieu of the position sensors 202 to verify or confirm whether the user is performing the walking/running activity successfully or unsuccessfully. As should be appreciated, the pressure sensors 190 may be used to verify or confirm that the user raised his or her foot off of the corresponding zone $Z_1$, $Z_2$ at the appropriate point in time. If the user's performance is successful, the pressure sensors 190 will send a confirmation signal to the control panel 28 and one of the indicator lights 402, 404 (e.g., a green light) will illuminate. However, if the user is unsuccessful, one or more of the pressure sensors 190 will send a signal to the control panel 28 and one of the indicator lights 402, 404 (e.g., a red light) will illuminate. The light 402, 404 indicating successful performance (e.g., the green light) will preferably remain illuminated until a misstep or miscue has been detected.

As discussed above, the control panel 28 may be configured to generate a visual signal on the display 30, an audible signal, and/or other types of signals to indicate that the user's performance was successful or unsuccessful. Additionally, it should be understood that the "signal" sent to the control panel 28 by the position sensors 202 and/or the pressure sensors 190 can take the form of an actual electronic signal or may take the form of the absence of an electronic signal.

With regard to the embodiment of the invention directed to measurement of a user's vertical jumping ability, reference is now made to FIGS. 11 and 12. It should be understood that the exercise devices 600 and 700 function in a similar manner, and that the discussion presented below with regard to various components associated with the exercise device 600 also applies to corresponding components of the exercise device 700. The basic function of the exercise devices 600 and 700 is to provide the user with a means to measure his or her vertical jumping ability and to provide feedback regarding various parameters associated therewith. The exercise devices 600 and 700 are also conducive to improving the user's vertical jumping ability via aerobic and anaerobic conditioning, and may also be used to practice and improve upon a wide variety of sport-specific skills during vertical jumping and conditioning exercises.

Some experts have defined a "vertical jump" as "jump reach minus standing reach", with "standing reach" defined as "how high you can extend one arm above your head while keeping both feet together and flat on the floor". (Bill Foran, NBA Strength Coach for the Miami Heat). Accordingly, "jump reach" is measured by jumping straight up without taking any steps (e.g., with both feet leaving the jumping surface at approximately the same time) and by touching or tapping the highest vertical point possible. In order to accurately measure a vertical jump, confirmation that both feet actually left the support surface 105 simultaneously is preferred in order to verify that the vertical jump was executed properly. As will be discussed in greater detail below, the exercise devices 600 and 700 are configured to accurately measure a user's vertical jumping ability as well as other related parameters associated with a vertical jump.

In order to determine standing reach, the sensor assembly 24 is initially positioned at its lowest operational position (as shown in FIGS. 11 and 12). The user stands upon the support pad 104, with both feet together and positioned flat on the upper support surface 105, and attempts to touch the button 631 of target sensor 630 with the fingertips of one hand. As should be appreciated, the height $h_2$ of the target button 631 above the upper support surface 105 can be adjusted by removing the pin 622 from the vertical support rod 604 and slidably displacing the upper tube portion 612 into or out of the lower tube portion 610, and then reinserting the pin 622 into the appropriate opening 618 to fix or lock the target button 631 at a selected height $h_2$. This process can be repeated until the user is just able to touch the target button 631 with his or her fingers while maintaining both of his or her feet flat upon the upper support surface 105. The resulting height $h_2$ will be the user's maximum standing reach. As discussed above, the indicia markings 620 on the upper tube portion 612 are preferably numerals that correspond to the height $h_2$ of the target button 631 relative to the upper support surface 105 when the sensor assembly 24 is positioned at its lowest operational position. Accordingly, the user or a third party, such as a coach, trainer, instructor, etc., can simply read the numeral 620 positioned just above the upper edge of the lower tube portion 610 to accurately determine the user's maximum standing reach.

After the user's standing reach is established, the sensor assembly 24 and the attached target system 602 are raised or lowered to a targeted vertical jump height via the adjustment mechanism 26. As should be appreciated, raising or lowering the sensor assembly 24 by a specific distance correspondingly raises or lowers the target system 602 by the same distance (i.e., the change in height $h_1$ of the position sensors 202 corresponds to the change in height $h_2$ of the target button 631 relative to the upper support surface 105). As should also be appreciated, raising or lowering the sensor assembly 24 and the target system 602 can be accomplished via direct input into the control panel 28 and/or via a remote control device (not shown). As a result, the user is able to control or set his or her anaerobic workout level. The control panel 28 may alternatively be programmed with predetermined jumping parameters or settings that will automatically vary the targeted jump height by raising and lowering the sensor assembly 24 and the attached target system 602 during the user's workout. In this manner, the user may perform a jumping exercise sequence without interruption or distraction. It should be appreciated that the sensor assembly 24 and the attached target system 602 may be raised or lowered to the appropriate height either before or during the user's workout, and may be adjusted automatically by the control panel 28 or manually by the user or a third party via direct input into the control panel 28 and/or by a remote control device (not shown).

Once the targeted jump height has been established, an indication or signal is given to cue the user to initiate the vertical jump attempt. In one embodiment, the jump signal is comprised of the activation/illumination of the light sources 132 in the base unit 22. In another embodiment, the jump signal may be comprised of the activation/illumination of one of the indicator lights 402, 404 on the control panel 28 (e.g., a green light) or both of the indicator lights 402, 404. In a further embodiment, the jump signal may be comprised of the activation of the position sensors 202 to generate visible light beams B. In yet another embodiment of the invention, the jump signal may be comprised of the generation of a visual signal on the display 30, an audible signal, and/or any other type of indication or signal that would occur to one of skill in the art.

The jump signal that cues the user to attempt a vertical jump can be given randomly by the control panel 28 and/or via input from a third party (e.g., by direct input into the control panel 28 or by a remote control device). In this manner, the user will not be able to anticipate the jump signal. However, it should be understood that the control panel may be programmed to initiate the jump signal after a select period of elapsed time. It should also be understood that the timing associated with initiation of the jump signal can be inputted and/or adjusted either before or during the user's workout. It should also be appreciated that the user can be signaled or cued to attempt multiple vertical jump attempts, with the period of time between successive jump attempts set at a predetermined time interval, a varying time interval, and/or a random time interval. Additionally, the control panel 28 may be configured or programmed to initiate the jump signal at a selected time interval +/−a select period of time (e.g., +/−two (2) seconds) to prevent the user from anticipating the jump signal. For example, if the selected time interval between jump attempts is set at thirty (30) seconds, the jump signal will be given within an interval of time ranging between twenty-eight (28) seconds and thirty-two (32) seconds. It should be appreciated that these time intervals, select periods of time, and time ranges are exemplary and do not in any way limit the scope of the present invention.

After the jump signal is given, a timer within the control panel 28 is started. Upon perceiving the jump signal, the user will immediately attempt a vertical jump. The pressure sensors 190 associated with the pressure sensitive pad or strip 108 may be used to determine when the user actually left the upper support surface 105. This may be accomplished, for example, via configuring or programming the control panel 28 to monitor the pressure sensors 190 that are activated (e.g., loaded) immediately prior to initiation of the jump signal, and to determine the precise point in time when the pressure sensors are deactivated (e.g., unloaded). As a result, the user's "reaction time" between initiation of the jump signal and the point in time in which the user's feet leave the upper support surface 105 may be measured/calculated by the control panel 28 and stored/recorded for later use by the user or a third party. Additionally, the elapsed period of time between deactivation of pressure sensors 190 (when the user leaves the upper support surface 105) and reactivation of the pressure sensors 190 (when the user returns to the upper support surface 105) may be measured/calculated by the control panel 28 to determine the user's "air time" (e.g. the total period of time in which the user is in the air). This information may also be stored/recorded in the control panel 28 for later use by the user or a third party.

The pressure sensors 190 may also be used to verify or confirm that both of the user's feet left the ground virtually simultaneously. This may be accomplished, for example, via configuring or programming the control panel 28 to monitor the pressure sensors 190 that are activated (e.g., loaded) immediately prior to initiation of the jump signal, and to verify that deactivation (e.g., unloading) of each of these pressure sensors 190 occurred at substantially the same time at some point subsequent to initiation of the jump signal. If the control panel 28 detects that some of the pressure sensors 190 were deactivated at different points in time, then the user is given a signal that the jump was improper. It should be understood that an elapsed time differential between deactivation of the pressure sensors 190 can be programmed into the control panel 28 to determine whether a jump is proper or improper. In this manner, the elapsed time differential between deactivation of the pressure sensors 190 can be varied to correspond to a selected criteria for determining whether a jump is proper or improper. An improper jump may be indicated via illumination of one of the indicator lights 402, 404 on the control panel 28 (e.g., a red light), the generation of a visual signal on the display 30, an audible signal, and/or any other type of indication or signal that would occur to one of skill in the art.

During the vertical jump, the user will attempt to strike the target button 631 which in turn activates the target sensor 630. Activation of the target sensor 630 sends a signal to the control panel 28 to verify or confirm that the user's vertical jump attempt was successful. A successful jump may be communicated to the user via illumination of one of the indicator lights 402, 404 on the control panel 28 (e.g., a green light), the generation of a visual signal on the display 30, an audible signal, and/or any other type of indication or signal that would occur to one of skill in the art. The light 402, 404 indicating a successful jump (e.g., the green light) will preferably remain illuminated until an unsuccessful jump is detected by the control panel 28.

In another embodiment of the invention, the position sensors 202 may be used in addition to or in lieu of the target sensor 630 to verify or confirm that the user's jump attempt was successful or unsuccessful. As should be appreciated, if the user jumps high enough to extend above the sensing plane S (i.e., above the light beams B), the position sensors 202 will send a signal to the control panel 28 to confirm that the user's vertical jump attempt was successful. However, if the user does not jump high enough to extend above the sensing plane S (i.e., at least one of the light beams B remains broken by the user's legs or feet), the position sensors 202 will send a signal to the control panel 28 indicating that the user's vertical jump attempt was unsuccessful. A successful or unsuccessful jump may once again be communicated to the user via illumination of a light, a visual signal on the display 30, an audible signal, and/or any other type of indication or signal that would occur to one of skill in the art.

The elapsed period of time between the point at which the user activates the target sensor 630 and/or extends above the sensing plane S and reactivation of the pressure sensors 190 (when the user returns to the upper support surface 105) may be measured/calculated by the control panel 28 to determine the user's "hang time" (e.g. the period of time in which the user remains in the air after reaching the targeted vertical jump height). This information may also be stored/recorded in the control panel 28 for later use by the user or a third party. Additionally, the elapsed period of time between deactivation of pressure sensors 190 (when the user leaves the upper support surface 105) and activation of the target sensor 630 and/or the point at which the user extends above the sensing plane S may be measured/calculated by the control panel 28 to determine the user's "acceleration time" (e.g., the time required for the user to accelerate from the upper support surface 105 to the target vertical jump height). Further, the elapsed period of time between initiation of the jump signal and activation of the pressure sensors 190 (when the user returns to the upper support surface 105) may be measured/calculated by the control panel 28 to determine the user's "total jump time". This information may likewise be stored/recorded in the control panel 28 for later use by the user or a third party. It should be understood that the exercise devises 600, 700 may also be used to measure/calculate other parameters associated with a user's vertical jumping ability.

As discussed above, the exercise device 600 includes a target apparatus 606 attached to an upper portion of the support rod 604. The target apparatus 606 is generally comprised of the target sensor 630 and a target attachment 640. The user activates the target sensor 630 by pressing or hitting the sensor button 631 to provide confirmation that a vertical jump attempt was successfully executed. In other words, the target sensor 630 is used to provide feedback regarding the success or failure of the user's vertical jump attempt. While not necessarily required for the proper operation of the exercise device 600, the target attachment 640 may be used to hone sport-specific skills during the user's vertical jumping routine. As discussed above, the target attachment 640 includes a holder 650 configured to retain a ball 652 in generally alignment with the target sensor 630. The user may activate or trigger the target sensor 630 by forcing, striking, hitting or pushing the ball 652 into contact with the target sensor button 631.

Accordingly, in addition to measuring/monitoring the user's vertical jumping ability and providing a workout conducive to improving the user's vertical jumping ability, the user is also provided with the opportunity to simultaneously practice and improve upon sport-specific skills. For example, if the ball 652 is a volleyball, the user may hone skills relating to spiking, volleying, tapping, etc. during the user's vertical jumping routine. Likewise, if the ball 652 is a soccer ball, the user may hone skills relating to heading, kneeing, kicking, etc. If the ball 652 is a football, the user may hone skills relating to batting, blocking, receiving, etc. The use of other types of balls or other sport-specific equipment is also contemplated for use in association with the exercise device 600 to hone other sport-specific skills and/or other more general skill sets.

Referring once again to FIG. 12, as discussed above, the exercise device 700 includes a target apparatus 706 attached to an upper portion of the support rod 704. The target apparatus 706 is generally comprised of the target sensor 730 and a target attachment 740. The user activates the target sensor 730 by pressing or hitting the sensor button 731 to provide confirmation that a vertical jump attempt was successfully executed. In other words, the target sensor 730 is used to provide feedback regarding the success or failure of the user's vertical jump attempt. While not necessarily required for the proper operation of the exercise device 700, the target attachment 740 may be used to hone sport-specific skills during the user's vertical jumping routine. As discussed above, the target attachment 740 includes a holder 750 configured to retain a ball 652 in generally alignment with the target sensor 630. The user may activate or trigger the target sensor 730 by grasping the ball 752 and engaging the ball 752 into contact with the target sensor button 731.

Similar to the exercise device 600 illustrated and described above, the exercise device 700 is also capable of not only measuring/monitoring the user's vertical jumping ability, but also providing the user the opportunity to simultaneously practice and improve upon various sport-specific skills. For example, if the ball 752 is a basketball, the user may hone skills relating to rebounding, blocking, tipping, etc. during the user's vertical jumping workout. As should be appreciated, since the holder 750 does not positively retain the ball 752, the user may grasp the ball 752 during a jumping cycle, force the ball into contact with the sensor button 731, remove the ball 752 from the holder 750, and return the ball to the holder 750 during a subsequent jumping cycle. The use of other types of balls or other sport-specific equipment is also contemplated for use in association with the exercise device 700 to hone other sport-specific skills and/or other more general skill sets.

Figure 13:
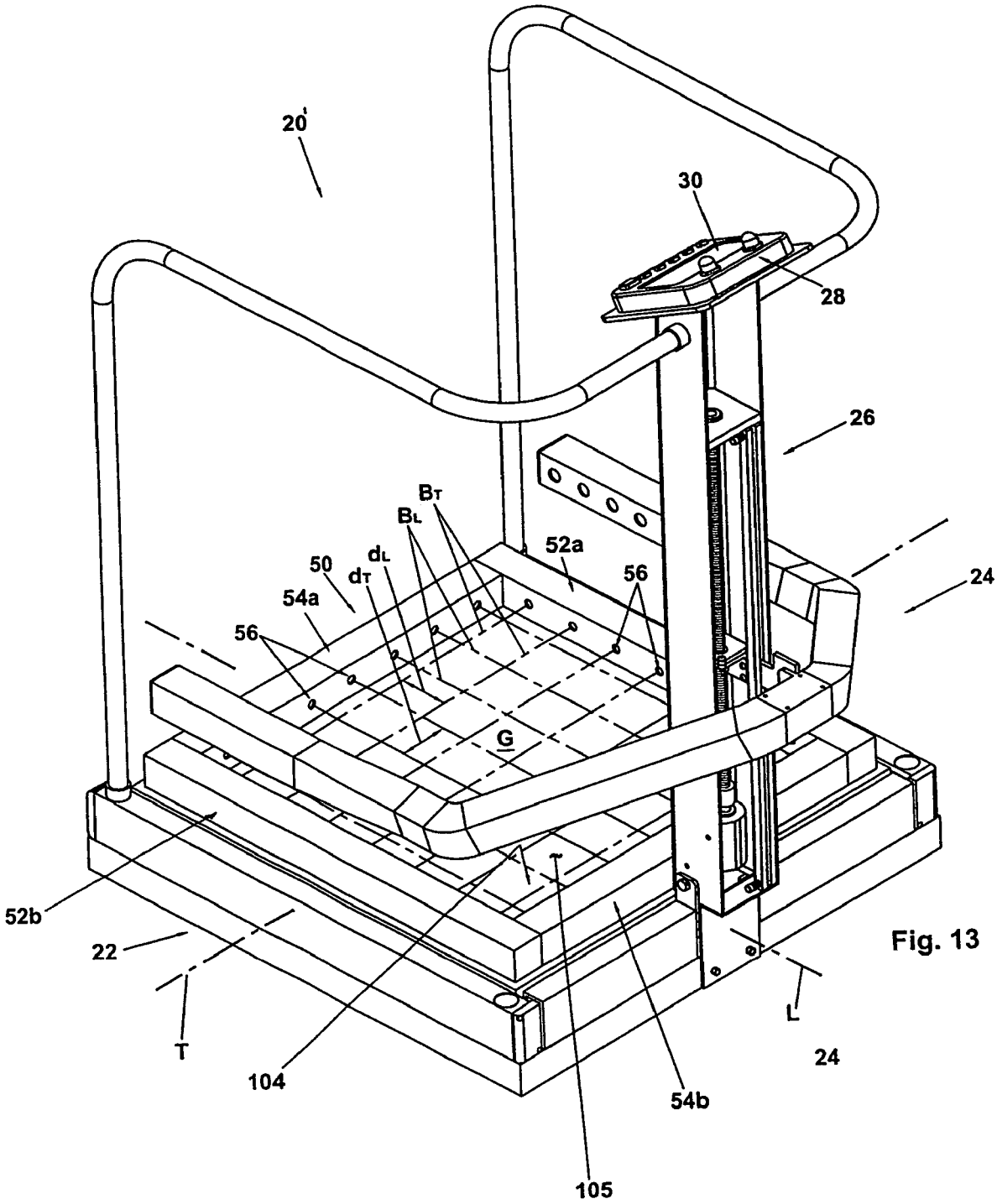
FIG. 13 is a rear elevational perspective view of an alternative embodiment of the exercise device illustrated in FIG. 1.

Referring to FIG. 13, shown therein is an alternative embodiment of the exercise device 20 illustrated and described above. In many ways, the exercise device 20' is configured similar to the exercise device 20, including a base unit 22, an adjustable position sensor assembly 24, an adjustment mechanism 26, a control panel 28, and a monitor or display 30. However, the exercise device 20' is additionally equipped with a stationary position sensor assembly 50.

In one embodiment of the invention, the stationary position sensor assembly 50 includes a number of sensor elements that serve to determine the position and/or orientation of the user's feet relative to the upper surface 105 of the support pad 104, the details of which will be discussed below. In other embodiments of the invention, the stationary position sensor assembly 50 may be used in a manner similar to that of the adjustable sensor assembly 24 to determine whether or not the user's response to a cue or signal satisfies a predetermined objective or goal, such as, for example, a predetermined elevation and/or an elapsed period of time. In the illustrated embodiment, the stationary position sensor assembly 50 is used in combination with the adjustable position sensor assembly 24. However, it should be understood that in other embodiments of the invention, the stationary position sensor assembly 50 may be used without the adjustable position sensor assembly 24.

According to one embodiment of the invention, the stationary position sensor assembly 50 is generally comprised of a pair of spaced apart mounting structures 52*a*, 52*b* extending along the length of the base unit 22 in a direction generally parallel with the longitudinal axis L, and a pair of spaced apart mounting structures 54*a*, 54*b* extending across the width of the base unit 22 in a direction generally parallel with the transverse axis T. The mounting structures 52*a*, 52*b* and 54*a*, 54*b* are preferably securely mounted to the support pad 104 or to other portions of the base unit 22. A plurality of position sensors 56 are mounted to each of the mounting structures 52*a*, 52*b* and 54*a*, 54*b*. Each of the position sensors 56 are preferably positioned at a predetermined distance above the support surface 105 so as to define a sensing grid G arranged approximately parallel with the support surface 105. In this manner, the position sensors 56 will be able to detect the presence or absence of the user's feet along the sensing grid G.

In one embodiment of the invention, the mounting structures 52*a*, 52*b* and 54*a*, 54*b* are configured substantially identical to one another and have a tubular configuration defining a hollow interior region for receiving the sensors 56. In a specific embodiment, the position sensors 56 are mounted within the tubes 52*a*, 52*b* and 54*a*, 54*b* in a manner similar to that described above with regard to the adjustable position sensor assembly 24 (e.g., via a mounting bracket similar to that of mounting bracket 216 and generally aligned with sensor apertures in the tubes similar to sensor apertures 212). However, it should be understood that other configurations of the mounting tubes 52*a*, 52*b* and 54*a*, 54*b* are also contemplated as falling within the scope of the present invention.

In one embodiment of the invention, the position sensors 56 are of the photoelectric type, with each position sensor 56 including opposing emitter and receiver units configured similar to the emitter and receiver units E, R illustrated and described above with regard to the position sensors 202 associated with the adjustable position sensor assembly 24. Similar to the position sensors 202 illustrated in FIG. 3, the opposing pairs of the emitter and receiver units are preferably arranged in a staggered or alternating configuration such that the receiver units are separated from one another by an intermediate emitter unit. As a result, the likelihood that a receiver unit will erroneously detect the light beam emitted from the wrong emitter unit is significantly reduced. However, it should be understood that other configurations are also contemplated, including configurations where all of the emitter units are mounted to one of the mounting tubes (e.g., tubes 52*a*, 54*a*) and all of the receiver units are mounted to the opposite mounting tube (e.g., tubes 52*b*, 54*b*).

Although the position sensors 56 have been described as photoelectric-type sensors, with each position sensor 56 including an emitter unit and a receiver unit, it should be understood that other types and configurations of position sensors are also contemplate as falling within the scope of the present invention. For example, instead of having separate emitter and receiver units, in other embodiments of the invention, the emitter and receiver elements may be integrated into a single unit, with an optical reflector mounted opposite the integrated position sensor to complete the optical sensor circuit. Additionally, in lieu of photoelectric-type sensors, the stationary position sensor assembly 50 may utilize other types of position sensors, including various types and configurations of laser sensors, fiber optic sensors, optical sensors, motion sensors, infrared sensors, thermal sensors, ultrasonic sensors, capacitive sensors, proximity sensors, or any other type of position sensor that would occur to one of skill in the art.

As illustrated in FIG. 13, the sensor assembly mounting tubes 52*a*, 52*b* and 54*a*, 54*b* extend about the outer perimeter of the support pad 104 and are positioned directly above the support surface 105. The position sensors 56 are disposed at intermittent locations along the mounting tubes 52*a*, 52*b* and 54*a*, 54*b*, preferably at uniform intervals, such that the longitudinal distance $d_L$ separating the position sensors 56 associated with the mounting tubes 52*a*, 52*b* is approximately equal to the transverse distance $d_T$ separating the position sensors 56 associated with the mounting tubes 54*a*, 54*b*. In this manner, the transverse beams of light $B_T$ emitted/received by the position sensors 56 associated with the mounting tubes 52*a*, 52*b* and the longitudinal beams of light $B_L$ emitted/received by the position sensors 56 associated with the mounting tubes 54*a*, 54*b* will form the sensing grid G at a predetermined distance above and preferably substantially parallel to the support surface 105.

As should be appreciated, the longitudinal and transverse distances $d_L$, $d_T$ separating the position sensors 56 may be increased/decreased to correspondingly vary the sensing density of the sensing grid G, which would in turn increase/decrease the sensing accuracy of the stationary position sensor assembly 50. As should also be appreciated, the longitudinal and transverse distances $d_L$, $d_T$ separating the position sensors 56 need not necessarily be equal to one another, but may instead take on different values to correspondingly vary the sensing density/accuracy along the longitudinal axis L relative to the sensing density/accuracy along transverse axis T. Additionally, although the position sensors 56 and the sensing grid G are illustrated as being positioned just above the support surface 105, it should be understood that the position sensors 56 and the sensing grid G may alternatively be positioned at other predetermined elevations above the support surface 105.

As should be appreciated, when there is no obstruction present between respective pairs of the emitter and receiver units, the corresponding light beams $B_T$, $B_L$ will remain unbroken and the receiver units will communicate a signal to the control panel 28 indicating an uninterrupted sensor condition. However, when any of the light beams $B_T$, $B_L$ are broken by an obstruction (e.g., by the user's feet) the receiver units will communicate a signal to the control panel 28 indicating an interrupted sensor condition. Accordingly, the position sensors 56 are capable of detecting the presence or absence of the user's feet along the sensing grid G, and are likewise capable of determining the position and/or orientation of the user's feet relative to the base unit 22, the details of which will be discussed below.

As indicated above, in one embodiment of the invention, the stationary position sensor assembly 50 may be used in a manner similar to that of the adjustable sensor assembly 24 to determine whether or not the user's response to a cue or signal satisfies a predetermined objective or goal. For example, the position sensors 56 may be used to determine whether or not the user has jumped or otherwise extended vertically beyond the sensing grid G, which for practical purposes would determine whether or not either of the user's feet have left the support surface 105 at the appropriate time in response to a signal or cue. The position sensors 56 may also be used to determine the approximate point in time in which the user's feet return to the support surface 105. In this regard, the position sensors 56 may be used in manner similar to that of the pressure sensors 190.

In a further embodiment of the invention, the stationary position sensor assembly 50 may be used to determine the position and/or orientation of the user's feet prior to, during, and/or after an activity, such as, for example, a jumping activity or a walking/running activity. With regard to a vertical jumping activity, immediately prior to initiation of a signal or cue instructing the user to jump off of the support surface 105, the position sensors 56 may be used to determine the position and/or orientation of the user's feet by determining which of the position sensors 56 are indicating an interrupted condition (i.e., an obstruction of the light beams $B_T$, $B_L$ by the user's feet). The receiver units indicating an interrupted condition will communicate a signal to the control panel 28, with the control panel 28 in turn determining or "plotting" the position and/or orientation of the user's feet along the sensing grid G. Additionally, immediately after completion of the jump (i.e., when the user's feet return to the support surface 105), the position sensors 56 may once again be used to determine or plot the position and/or orientation of the user's feet. In this manner, the stationary position sensor assembly 50 may be used to determine the overall efficiency of the user's vertical jump attempt. For example, if the user's feet are determined to be in approximately the same position and orientation immediately after the jump attempt as they were immediately prior to the jump attempt, the measured efficiency of the jump will be high. However, if the user's feet are in a different position and/or orientation, the measured efficiency of the jump will be comparatively low.

With regard to a walking/running activity, plotting the position and orientation of the user's feet during a walking/running activity may provide useful feedback to measure and monitor walking/running mechanics. This may be particularly useful with regard to therapeutic applications to provide a therapist, trainer or other personnel with real time feedback regarding the positioning and orientation of the user's feet during a walking/running activity. It should be understood that the stationary position sensor assembly 50 may be used in applications other than those specifically described above, including the use of multiple parallel sensor assemblies, and that the particular embodiments discussed herein are exemplary, it being understood that other applications are contemplated as falling within the scope of the present invention.

Although the position sensor assemblies 24 and 50 and the pressure sensitive pad or strip 108 have been described as being primarily used as a means to provide a signal or indication corresponding to the user's position relative to the support surface 105, it should be understood that these elements may also be used as a means to measure parameters associated with the user's performance of various activities. For example, with regard to a jump rope simulation activity, the position sensor assemblies 24, 50 and/or the pressure pad 108 may be used to measure the jump speed, cadence or jump height of the user. This measurement may in turn be used to adjust the settings of the exercise device (e.g., speed or cadence at which the light channels 170 are activated/deactivated and/or the height of the sensor assembly 24) to more closely match the capabilities of the user. Similarly, with regard to the activities of walking or running in place, the position sensor assemblies 24, 50 and/or the pressure pad 108 may likewise be used to measure parameters associated with walking or running (e.g., speed, distance, stride length, foot height, etc.), which may in turn be used to adjust the settings of the exercise device to more closely match the capabilities of the user. A similar arrangement may also be used in association with the vertical jumping activity.

In a further embodiment of the invention, one or more of the exercise device embodiments illustrated and described above may include a closed loop feedback mode whereby the user would have the ability, if desired, to input their weight, the length of time they wish to jump, the cadence at which they would like to jump, how many calories they would like to burn, the height that they want to jump, and/or any other parameter or criteria relating to the user and/or to the activity of the user, all as a means of goal setting. The user would be able to select any one of the inputs, all of the inputs, or any combination of the inputs. In addition, the exercise device would have the ability to break down the total exercise time into smaller time segments whereby the desired speed and height might change from one exercise segment to another.

Regardless of the inputs selected, the light channels below the user's feet will illuminate sequentially faster as the user jumps faster and slower as the user jumps slower. The light channels will illuminate sequentially as soon as the sensors indicate that the user's feet have left the jumping surface, thereby showing the virtual jump rope successfully passing beneath the user's feet. Should the user desire to merely jump indiscriminately at various cadences and heights and be timed as to how long the user has been exercising and be provided with feedback with regard to the selected exercise activity, the device will permit this as well. The user will start the device and jump at a selected cadence and height, either of which can be automatically changed by jumping at a cadence that is faster/slower and/or higher/lower, completely at the user's discretion. The device would then provide immediate feedback as to how fast they are jumping (in jumps per minute or JPMs), how high they are jumping (in inches or centimeters), how many calories per hour they are burning, how many total calories they have burned during the session, how long they have been exercising, and/or how long they have to jump to achieve their goal. In addition, an average cadence and average rope height will be calculated for the entire exercise session. If the user would like to merely count calories, they can also achieve this by simply jumping on the device.

If preprogrammed goals are selected for speed and height, and those goals are being met, a green light will illuminate or another type of indicia will be activated with every successful jump, and the display will reflect the measured instantaneous speed and height. If one or both of the parameters are not being met (i.e., if the user is jumping too slow or not jumping high enough), a red light will illuminate or another type of indicia will be activated with every unsuccessful jump until the deficiency is remedied. For example, the display which illustrates the measured speed at which the user is jumping will flash repeatedly in the form of a flashing number if the user's cadence is too slow, and/or the display which illustrates the measured jump height will show a flashing number if the jump height is too low. In addition, an average cadence and average rope height will be calculated for the entire session. Also, one or more displays may show the percentage of jumps that have met or exceeded the speed goal and/or the percentage of jumps that have met or exceeded the height goal.

If the user wishes to merely input the number of calories they would like to burn, they can input their weight, desired cadence and desired rope height and the device will calculate the time required to achieve this goal. The calculated time to meet the calorie goal will then be displayed and counted down. The device will still continuously calculate calories burned based on the actual exercise performed. If the user falls short of their calorie goal based on their activity at the end of the allotted time period, the time display will reset showing the amount of additional time that will be required based on an average of the activity level of the user throughout the duration of the original time period calculated. If the user does not select a cadence and rope height, the device will merely count calories based on the cadence and height of each jump and the time display will count up until the caloric goal is achieved. The calorie calculations will be estimated by data currently being collected through research that is being performed on the device and will take both cadence and rope height into consideration. In the absence of the user inputting their weight, all calorie calculations will be based on the assumption that the user weighs 150 pounds, which corresponds to the use weight standard in the exercise industry.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. An exercise device, comprising:

a support surface;

at least two position sensors arranged along a sensing plane extending one of generally parallel and obliquely relative to said support surface, said at least two position sensors adapted to detect a presence of a user along said sensing plane;

a vertical support member extending generally perpendicular relative to the support surface, said at least two position sensors adjustably coupled to said vertical support member to provide vertical adjustment to said at least two position sensors to correspondingly vary a height of said sensing plane above said support surface; and a controller in communication with said at least two position sensors to determine a position of the user relative to said sensing plane, said controller including a closed loop feedback mode adapted to process at least one input parameter provided by the user, said closed loop feedback mode adapted to measure a performance criteria of the user related to said input parameter and to provide feedback to the user indicative of a measurement of said performance criteria.

2. The exercise device of claim 1, wherein said sensing plane is arranged generally parallel to said support surface.

3. The exercise device of claim 1, wherein said at least two position sensors emit a visible beam of light along said sensing plane.

4. The exercise device of claim 1, wherein said at least two position sensors are arranged to define a sensing grid extending along said sensing plane.

5. The exercise device of claim 4, wherein a first of said position sensors is arranged at approximately a ninety degree angle relative to a second of said position sensors to define said sensing grid.

6. The exercise device of claim 1, further comprising a position adjustment mechanism coupled to said at least two position sensors and an electric motor coupled to said position adjustment mechanism to provide said vertical adjustment to said at least two position sensors to correspondingly vary said height of said sensing plane above said support surface.

7. The exercise device of claim 1, further comprising at least one position sensor adapted to detect a presence of the user standing upon said support surface.

8. The exercise device of claim 1, further comprising:

at least two stationary position sensors arranged to define a sensing grid relative to said support surface, a first of said stationary position sensors arranged at approximately a ninety degree angle relative to a second of said stationary position sensors to define said sensing grid.

9. The exercise device of claim 8, wherein said sensing grid is arranged generally parallel to said support surface.

10. An exercise device comprising:

a support surface;

a plurality of sensors arranged along a sensing plane relative to the support surface, the plurality of sensors being configured to send signals indicative of at least one of a speed and a magnitude associated with an activity performed by a user in relation to the support surface;

a display configured to provide the user with information related to at least one of the speed and the magnitude of the activity in response to the user performing the activity;

an input device configured to receive an input from the user associated with a goal related to performance of the activity; and a controller in communication with the plurality of sensors and the display, the controller configured to operate according to a closed loop feedback mode, wherein the controller is configured to receive the signals indicative of at least one of the speed and the magnitude associated with an activity performed by the user and output information related to the goal to the display.

11. The device of claim 10, wherein the activity comprises jumping.

12. The device of claim 11, wherein the speed associated with the activity comprises cadence of the jumping.

13. The device of claim 11, wherein the magnitude associated with the activity comprises height of the jumping.

14. The device of claim 10, wherein the goal related to performance of the activity comprises at least one of a desired length of duration of performance of the activity, a desired speed associated with performance of the activity, a desired number of calories burned during performance of the activity, and a desired magnitude associated with performance of the activity.

15. The device of claim 10, further comprising a plurality of lights associated with the support surface, wherein the controller is configured illuminate at least one of the lights in relation to performance of the activity.

16. The device of claim 15, wherein the controller is configured to illuminate at least some of the plurality of lights to simulate a motion associated with the support surface in relation to performance of the activity.

17. The device of claim 16, wherein the motion comprises movement of a jump rope beneath the user.

18. The device of claim 10, wherein the controller is configured to update the goal based on the signals indicative of at least one of the speed and the magnitude associated with the activity performed by the user.

19. The device of claim 10, wherein the information related to at least one of the speed and the magnitude of the activity comprises at least one of a cadence associated with performance of the activity, a magnitude associated with performance of the activity, a rate of calories burned during performance of the activity, total calories burned during performance of the activity, duration of performance of the activity, and length of performance of the activity required to achieve the goal.

20. The device of claim 10, wherein the information related to at least one of the speed and the magnitude of the activity comprises displaying an indication of whether the goal is being achieved during performance of the activity.

* * * * *

UNITED STATES PATENT AND TRADEMARK OFFICE

CERTIFICATE OF CORRECTION

PATENT NO. : 7,604,571 B2
APPLICATION NO. : 11/542070
DATED : October 20, 2009
INVENTOR(S) : Larry C. Wilkins and Vaughn Scott It is certified that error appears in the above-identified patent and that said Letters Patent is hereby corrected as shown below:

In claim 15, column 32, line 39, "configured illuminate" should read --configured to illuminate--.

Signed and Sealed this

Fifteenth Day of December, 2009

David J. Kappos

David J. Kappos
*Director of the United States Patent and Trademark Office*